US010751580B2

(12) United States Patent
Jennings

(10) Patent No.: US 10,751,580 B2
(45) Date of Patent: Aug. 25, 2020

(54) BALL COLLECTION DEVICE

(71) Applicant: James Douglas Jennings, Boca Raton, FL (US)

(72) Inventor: James Douglas Jennings, Boca Raton, FL (US)

( * ) Notice: Subject to any disclaimer, the term of this patent is extended or adjusted under 35 U.S.C. 154(b) by 0 days.

(21) Appl. No.: 16/355,962

(22) Filed: Mar. 18, 2019

(65) Prior Publication Data

US 2019/0209899 A1 Jul. 11, 2019

Related U.S. Application Data

(63) Continuation of application No. 15/948,426, filed on Apr. 9, 2018, now Pat. No. 10,232,229, which is a continuation-in-part of application No. 15/236,452, filed on Aug. 14, 2016, now Pat. No. 9,937,386.

(60) Provisional application No. 62/205,360, filed on Aug. 14, 2015.

(51) Int. Cl.

| | |
|---|---|
| ***A63B 47/02*** | (2006.01) |
| *A63B 102/32* | (2015.01) |
| *A63B 102/02* | (2015.01) |

(52) U.S. Cl.

CPC ..... *A63B 47/024* (2013.01); *A63B 2102/02* (2015.10); *A63B 2102/32* (2015.10); *A63B 2210/50* (2013.01); *A63B 2225/09* (2013.01)

(58) Field of Classification Search

CPC ..... A63B 47/024; A63B 2102/02; A63B 2210/50

USPC ..... 294/19.2, 179; 414/439, 440; 473/431, 473/460; 171/63; 56/328.1

See application file for complete search history.

(56) References Cited

U.S. PATENT DOCUMENTS

| | | | | | |
|---|---|---|---|---|---|
| 2,817,405 | A * | 12/1957 | Pearson | A63D 5/02 | 171/63 |
| 2,849,743 | A * | 9/1958 | Mcfarland | A47L 13/52 | 15/257.2 |
| 3,593,868 | A * | 7/1971 | Folz | A63B 47/021 | 414/440 |
| 4,549,758 | A * | 10/1985 | Meshulam | A63B 47/02 | 294/19.2 |
| 4,602,401 | A * | 7/1986 | Holroyd | B05C 17/10 | 15/144.1 |
| 4,721,428 | A * | 1/1988 | Rohrer | A63B 47/021 | 414/439 |
| 5,147,100 | A * | 9/1992 | Frankel | A63B 47/021 | 294/19.2 |
| 6,858,603 | B2 * | 2/2005 | Achard | C07D 401/06 | 514/210.01 |

(Continued)

*Primary Examiner* — Paul T Chin
(74) *Attorney, Agent, or Firm* — Nicholas R. Lewis, P.A.

(57) ABSTRACT

A ball collection device, including a handle; a first tube segment and a second tube segment coupled substantially perpendicularly to the handle; a multi-directional roller ball coupled to the first and second tube segments; a crossbar coupled to the handle adjacent and substantially parallel to the first and second tube segments; a first arm coupled to and extending substantially perpendicular from the first tube segment; a first wing extending from the first arm that is configured to deflect objects downward; a second arm coupled to and extending substantially perpendicular from the second tube segment; a second wing extending from the second arm that is configured to deflect objects downward; and at least one roller rotatably mounted on each of the first and second tube segments and the crossbar.

18 Claims, 19 Drawing Sheets

(56) References Cited

U.S. PATENT DOCUMENTS

| | | | | |
|---|---|---|---|---|
| 7,178,258 | B2 * | 2/2007 | Towne | G01B 3/12 294/19.2 |
| 8,075,030 | B2 * | 12/2011 | Pearson | A63B 47/02 294/179 |
| 8,602,711 | B1 * | 12/2013 | Nash | A63B 47/021 294/19.2 |
| 8,920,101 | B2 * | 12/2014 | Leyco | A63B 47/021 294/19.2 |
| 9,480,885 | B1 * | 11/2016 | Tarwater | A63B 47/021 |
| 9,764,202 | B2 * | 9/2017 | Chen | A63B 47/021 |
| 2006/0082171 | A1 * | 4/2006 | Olmstead | A63B 47/021 294/19.2 |
| 2010/0314893 | A1 * | 12/2010 | Pearson | A63B 47/02 294/19.2 |
| 2012/0093621 | A1 * | 4/2012 | Reyes | A63B 47/021 414/507 |
| 2012/0161407 | A1 * | 6/2012 | Thicke | B62B 3/0612 280/47.35 |
| 2013/0064631 | A1 * | 3/2013 | Leyco | A63B 47/021 414/439 |
| 2013/0269285 | A1 * | 10/2013 | Hovenier | E04G 21/167 52/745.11 |
| 2014/0294547 | A1 * | 10/2014 | Guo | A63B 47/021 414/507 |

* cited by examiner

BALL COLLECTION DEVICE

CROSS-REFERENCE TO RELATED APPLICATION

This application is a continuation of patent application Ser. No. 15/948,426, filed Apr. 9, 2018, entitled BALL COLLECTION DEVICE, which application is a continuation-in-part of patent application Ser. No. 15/236,452, filed Aug. 14, 2016, entitled BALL COLLECTION DEVICE (now issued U.S. Pat. No. 9,937,386), which application is related to and claims priority to U.S. Provisional Patent Application Ser. No. 62/205,360, filed Aug. 14, 2015, entitled BALL COLLECTION DEVICE, the entirety of all of which is incorporated herein by reference.

STATEMENT REGARDING FEDERALLY SPONSORED RESEARCH OR DEVELOPMENT n/a

FIELD OF THE INVENTION

The present disclosure relates to a ball collection device and, more particularly, to a push broom-style ball collector that has improved maneuverability.

BACKGROUND OF THE INVENTION

Push broom style ball collectors are known. For example, U.S. Pat. No. 8,075,030 to Robert Pearson et al. (the '030 patent), discloses a foldable device for retrieving golf, tennis or other balls. In the '030 patent, a strap or length of cord formed from nylon or another resilient material is secured to a side of the mesh material adjacent brace member and forms a loop or lilting handle. A pair of wheels or castors is secured to the undersides of the arm members and at the first ends.

U.S. Pat. No. 2,817,405 to W. C. Pearson discloses a bowl retriever having a generally trapezoidal shape. The sides of the trapezoidal frame extend forwardly at equal obtuse angles relative to a bearing member or rear side of the frame. The frame is supported by two caster wheels located at the forward ends of the frame sides, remote from the bearing member, and by two axially spaced elongate rollers that are mounted beneath, and extending longitudinally of, the bearing members on suitable journal brackets.

Similarly, U.K. Patent No. 539,348 to Atcherley discloses a wheeled collecting device having a handle, rubber covered rollers on its front face adapted to engage with the bowls so that the bowls will roll easily in front of the device, and which is supported by rubber-tired castors or other wheels.

Additionally, certain ball collector products are available in the market, such as the Scorpion Ball Sweeper, the Green Rake by Range Servant, and the Dry Court Tennis Ball Sweeper by Tennisnuts™.

What is needed is a push broom-type ball collector that is easy to manipulate and rotate in any direction.

SUMMARY OF THE INVENTION

It is accordingly an object of the present disclosure to provide a push broom-type ball collector that solves the disadvantages of ball collecting devices of the prior art. In particular, it is an object of the present disclosure to provide a ball collecting device that can be moved easily in any direction and is easy to manipulate and use. In one particular embodiment of the disclosure, a push broom-type ball collector is provided that utilizes a multi-directional center roller ball that permits the collector to be manipulated and rotated in any direction.

The present disclosure advantageously provides a ball collection device, including a handle; a multi-directional roller ball coupled to an end of the handle; a bottom tube coupled to the roller ball substantially perpendicular to the handle; a first arm coupled to and extending substantially perpendicular from the bottom tube; and a second arm coupled to and extending substantially perpendicular from the bottom tube. The bottom tube may include a first tube segment and a second tube segment, wherein the first and second tube segments enclose at least a portion of the roller ball. The ball collection device may include a ball shield covering at least a portion of the roller ball, wherein the ball shield may be configured to deflect external objects away from the roller ball. At least one of the first and second arms may include a wing extending at an angle therefrom and/or may include a crossbar coupled to the handle adjacent to the bottom tube. The crossbar may be substantially parallel to the bottom tube and/or may be substantially V-shaped. The ball collection device may include at least one roller coaxially and rotatably mounted on the crossbar and/or a curvilinear support bracket connecting the handle to at least one of the crossbar and bottom tube. The ball collection device may include at least one roller coaxially and rotatably mounted on the bottom tube and/or may include a first wheel coupled to the first arm and a second wheel coupled to the second arm. The handle of the ball collection device may be selectively adjustable.

A ball collection device is disclosed, including a handle; at least one crossbar coupled substantially perpendicular to the handle; a multi-directional roller ball coupled to the at least one crossbar; and a plurality of arms, wherein the at least one crossbar and the plurality of arms form a ball capture region. The at least one crossbar may include a bottom tube and a crossbar substantially parallel and vertically adjacent to the bottom tube. The bottom tube may include a first tube segment and a second tube segment, wherein the first and second tube segments enclose at least a portion of the roller ball. Each of the plurality of arms may include a wing extending at an angle therefrom configured to direct balls towards the ball capture region. The ball collection device may include a plurality of rollers rotatably coupled to the at least one crossbar. Each of the plurality of rollers may be concentrically mounted on the at least one crossbar.

A ball collection device is disclosed, including a handle; a first tube segment and a second tube segment coupled substantially perpendicularly to the handle; a multi-directional roller ball coupled to the first and second tube segments; a crossbar coupled to the handle adjacent and substantially parallel to the first and second tube segments; a first arm coupled to and extending substantially perpendicular from the first tube segment; a first wing extending from the first arm that is configured to deflect objects downward; a second arm coupled to and extending substantially perpendicular from the second tube segment; a second wing extending from the second arm that is configured to deflect objects downward; and at least one roller rotatably mounted on each of the first and second tube segments and the crossbar. The handle of the ball collection device may be selectively adjustable.

A ball collection device is provided, including a handle; a first tube segment and a second tube segment coupled substantially perpendicularly to the handle; a multi-directional roller ball coupled to the first and second tube segments; a crossbar coupled to the handle horizontally offset from the first and second tube segments; a first arm coupled to and extending substantially perpendicular from the first tube segment; a first wing extending from the first arm that is configured to deflect objects downward; a second arm coupled to and extending substantially perpendicular from the second tube segment; a second wing extending from the second arm that is configured to deflect objects downward; and a plurality of rollers rotatably coupled to the crossbar. The plurality of rollers may include a first plurality of rollers substantially aligned with each other and vertically adjacent to a second plurality of rollers substantially aligned with each other.

Although the devices illustrated and described herein as embodied in a rolling ball collector, it is nevertheless not intended to be limited to the details shown, since various modifications and structural changes may be made therein without departing from the spirit of the disclosure and within the scope and range of equivalents of the claims.

The construction and method of operation of the devices, however, together with additional objects and advantages thereof will be best understood from the following description of specific embodiments when read in connection with the accompanying drawings.

A ball collection device is disclosed, including a base; a plurality of rollers coupled to the base; a first arm coupled to and extending substantially perpendicular from the base; a second arm coupled to and extending substantially perpendicular from the base; and at least one of a ball and a wheel movably coupled to the base. The ball and/or wheel may include a multi-directional roller ball. The device may include an elongated handle extending from the base. A length of the handle may be selectively adjustable. The plurality of rollers may include at least two rows of rollers, where the at least two rows may be substantially parallel to each other. Each of the plurality of rollers may be rotatable around an axis that is substantially parallel to the base. At least one of the first and second arms may define a substantially rounded triangular shape. The device may include a rollerball coupled to at least one of the first and second arms. The rollerball may be rotatable around an axis that is substantially parallel to the at least one of the first and second arms. Each of the first and second arms may include a rollerball coupled thereto, wherein each rollerball is rotatable around an axis that is substantially parallel to the first and second arms. The device may include a motor coupled to the base configured to propel the ball collection device. The device may include a controller coupled to the base; and at least one sensor in communication with the controller and configured to detect contact between the device and another object, where the controller is configured to modify operation of the motor at least based in part on a communication received from the at least one sensor. The device may include a controller coupled to the base; and at least one proximity sensor in communication with the controller, where the controller is configured to modify operation of the motor at least based in part on a communication received from the at least one proximity sensor. The first and second arms may define a capture region therebetween, and the device may further include at least one sensor configured to detect objects located in the capture region. The at least one sensor may include at least one of an optical sensor, an infrared sensor, and a laser sensor.

A ball collection device is disclosed, including a base; a plurality of rollers coupled to the base; a first arm coupled to and extending substantially perpendicular from the base; a second arm coupled to and extending substantially perpendicular from the base, wherein the first and second arms define a capture region therebetween; a motor coupled to the base to propel the device; a controller operably connected to the motor; and at least one of a proximity sensor and contact sensor coupled to the device, wherein the controller is configured to adjust operation of the motor in response to a communication from the at least one of a proximity sensor and contact sensor. The motor may be coupled to a multi-directional rollerball coupled to the base. The plurality of rollers may include a first plurality of rollers substantially aligned with each other and vertically adjacent to a second plurality of rollers substantially aligned with each other. The device may include at least one of an optical sensor, an infrared sensor, and a laser sensor coupled to the device that is configured to detect objects located in the capture region. The device may include an elongated handle removably coupled to the base.

BRIEF DESCRIPTION OF THE DRAWINGS

A more complete understanding of the present disclosure, and the attendant advantages and features thereof, will be more readily understood by reference to the following detailed description when considered in conjunction with the accompanying drawings wherein.

DETAILED DESCRIPTION OF THE INVENTION

Figure 1:
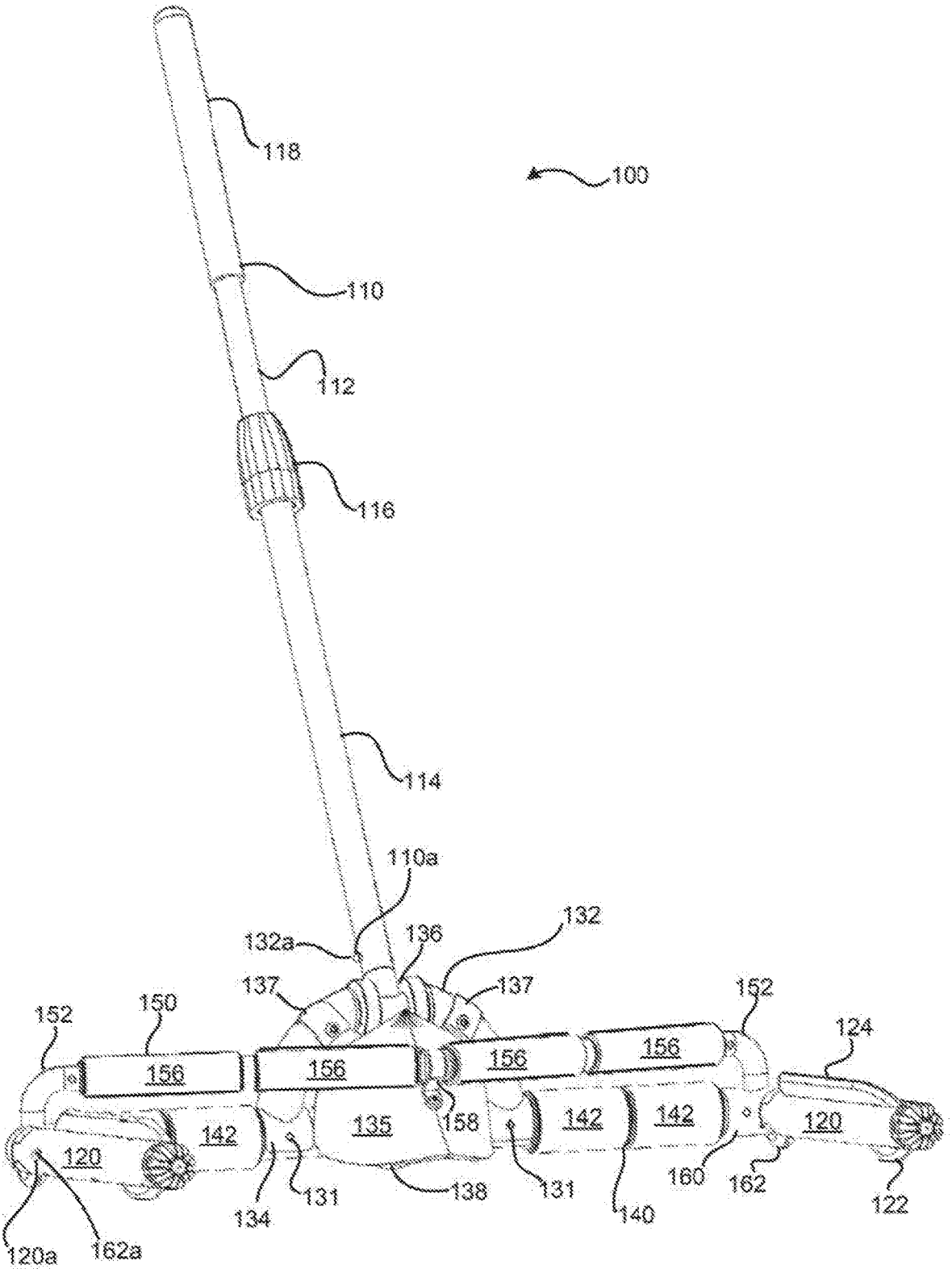
FIG. 1 is an isometric view of a ball collection device in accordance with one particular embodiment of the present disclosure.
Figure 2:
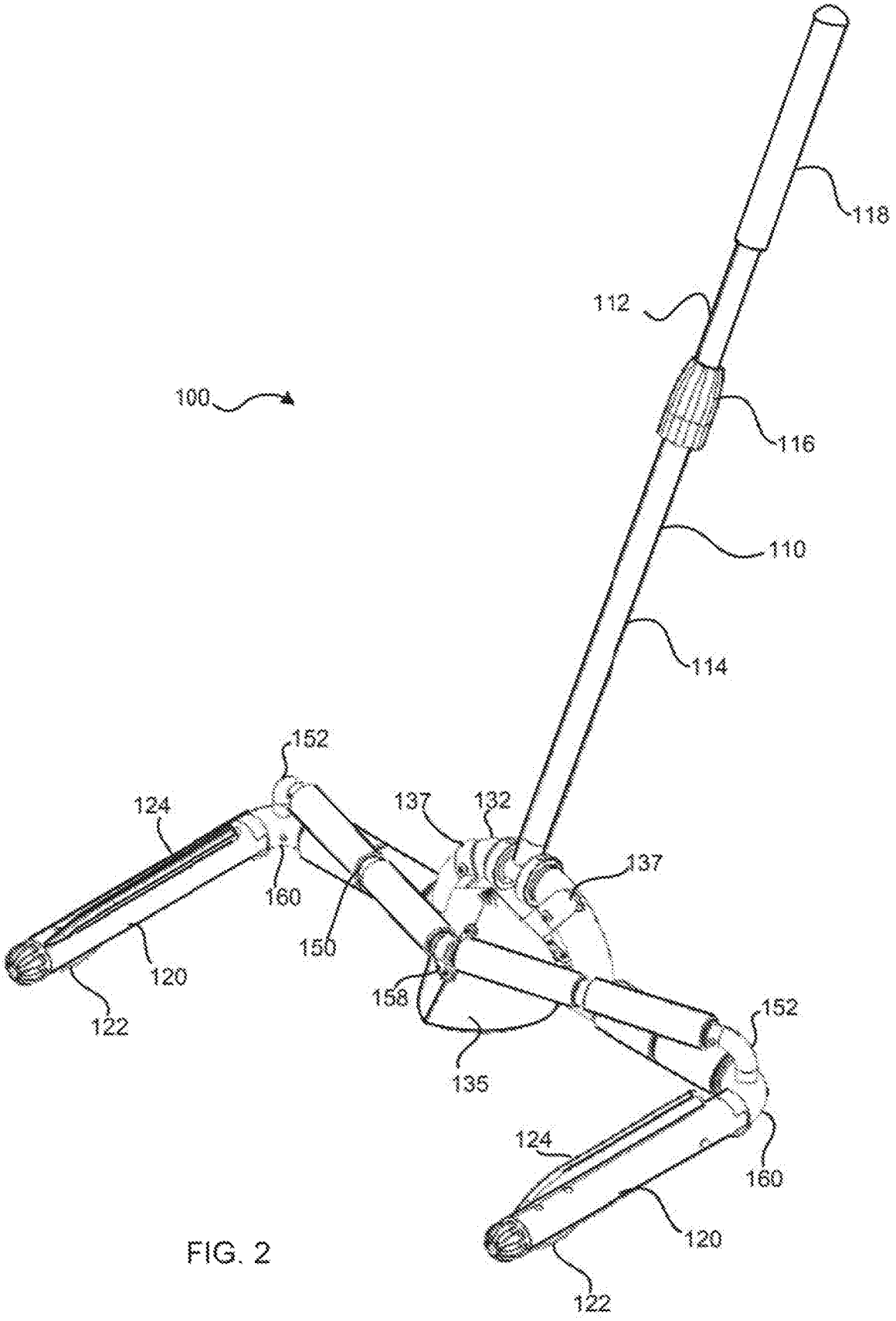
FIG. 2 is a perspective view of a ball collection device in accordance with one particular embodiment of the disclosure.
Figure 3:
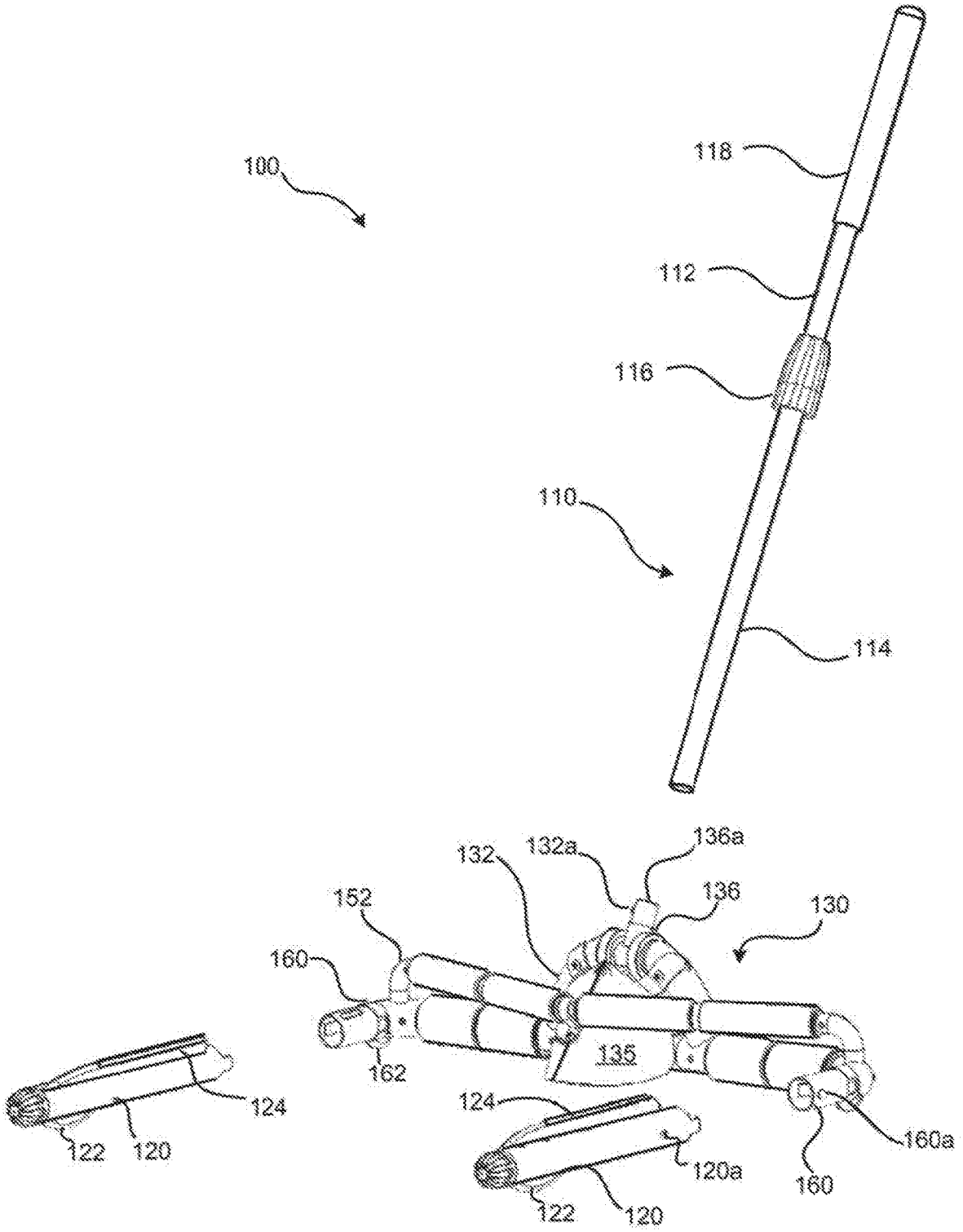
FIG. 3 is an exploded view of the ball collection device of FIG. 2.
Figure 4:
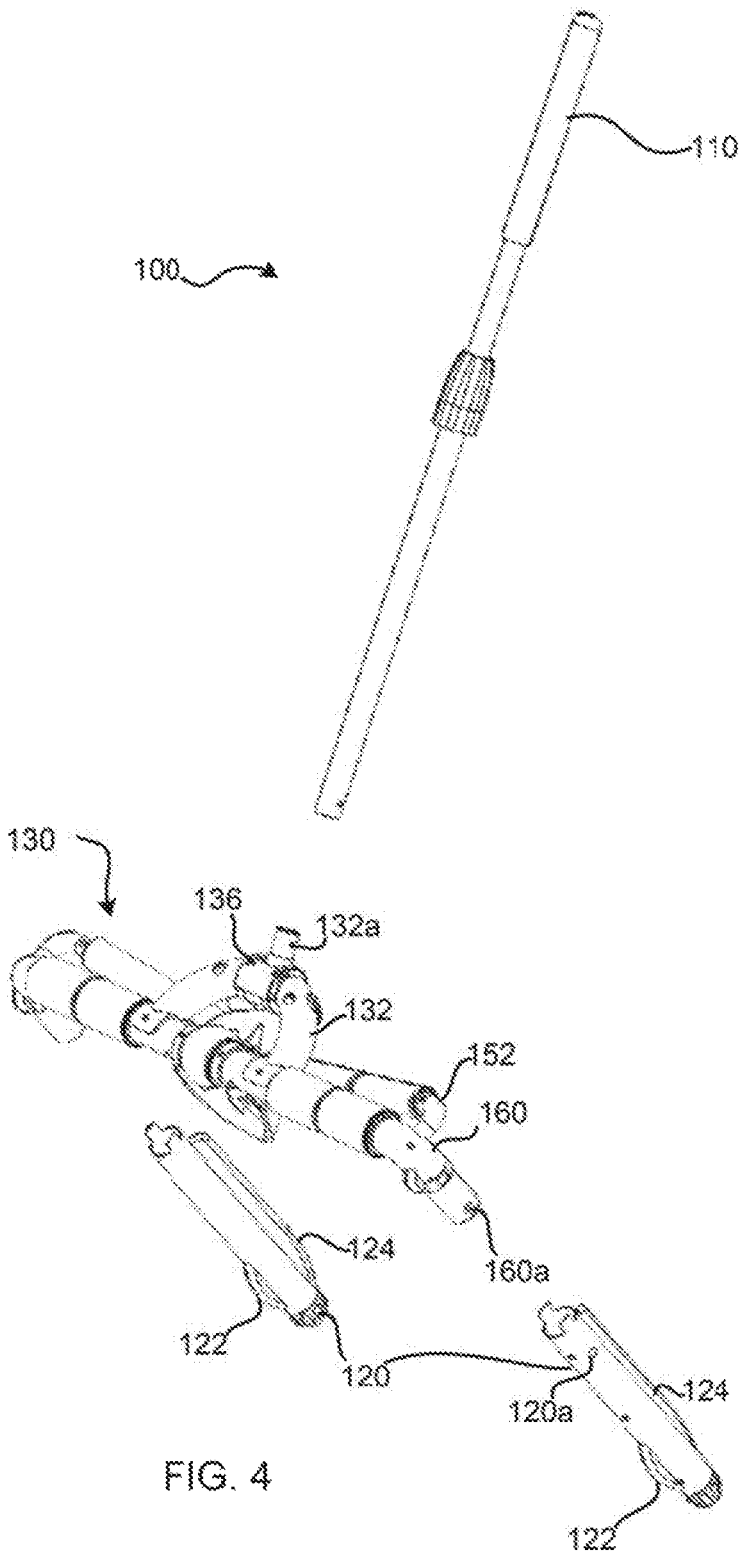
FIG. 4 is an exploded view, taken from the bottom, of the ball collection device of FIG. 2.

Referring now to FIGS. 1-6, there is shown one particular embodiment of a ball collection device 100. The ball collection device 100 is a push-broom style ball collector including a handle 110, arms 120, and a backplane 130. Each of the handle 110 and the arms 120 are connected to, and removable from, the backplane 130 via a fastening mechanism. In one particular embodiment of the devices illustrated in the figures, the fastening mechanism includes a spring pin and hole combination. The disclosure is not meant to be limited to this, however, as other ways of fixing the handle 110 and arms 120 to the backplane 130, such as, welding, screwing, pinning, etc., can be used to removably or permanently connect the handle 110 and/or arms 120 to the backplane 130 without departing from the scope of the present disclosure.

The Handle: As discussed above, the ball collection device 100 includes a handle or main handle assembly 110, with which it can be pushed and/or maneuvered. In one particular embodiment of the disclosure illustrated in the figures, the handle 110 is a telescoping handle made from two or more concentric pipe sections 112, 114, with a rotating locking member 116 that permits the length of the handle 110 to be selected and set at a preferred length. In the preferred embodiment illustrated, the handle 110 additionally includes a grip 118, for ease in grasping the handle and for comfort. The handle 110 may be coupled to one or more components described herein employing a variety of rotational, pivotal, or other movable joint mechanisms to allow the angle of the handle 110 to be freely moved and changed during use of the ball collection device 100.

The Backplane: The backplane 130 includes a bottom tube 140, which acts as the base component of the backplane 130, to which all of the other elements of the backplane 130 are connected. For example, a support bracket 132 is mounted to the bottom tube 140 via curved brackets 134 bolted to the bottom tube 140 using mechanical fasteners or bolts 131. This is not meant to be limiting, as the curved brackets 134 could be permanently fixed to the bottom tube through welding, gluing, pinning, etc., as desired. In one particular embodiment of the disclosure, the bottom tube 140 is formed from anodized aluminum tubing, although other materials may be used without departing from the spirit or scope of the present disclosure. Further, although referred to as a "tube," the cross-sectional shape and construct of the bottom tube 140 is not limited to circular or hollow embodiments.

In the present preferred embodiment, the handle 110 connects to, and is removable from, the support bracket 132, via a fastening mechanism or fastener 115. In one particular embodiment, the pipe section 114 mates concentrically with a pipe section 136*a* (or, alternately, a socket, not shown) of the support bracket 132 and the fastener includes a spring pin 132*a* on a portion of the support bracket 132 that mates with a hole 110*a* through the shaft of pole 114, or vice-versa. A portion 136 of the support bracket 132 is provided at a particularly defined angle, so that the handle 110 connected thereto is at a non-perpendicular angle with respect to the ground. If desired, the angle of the portion 136 may be adjustable to permit the user to change the angle of the handle 110 relative to the ground.

Figure 5A:
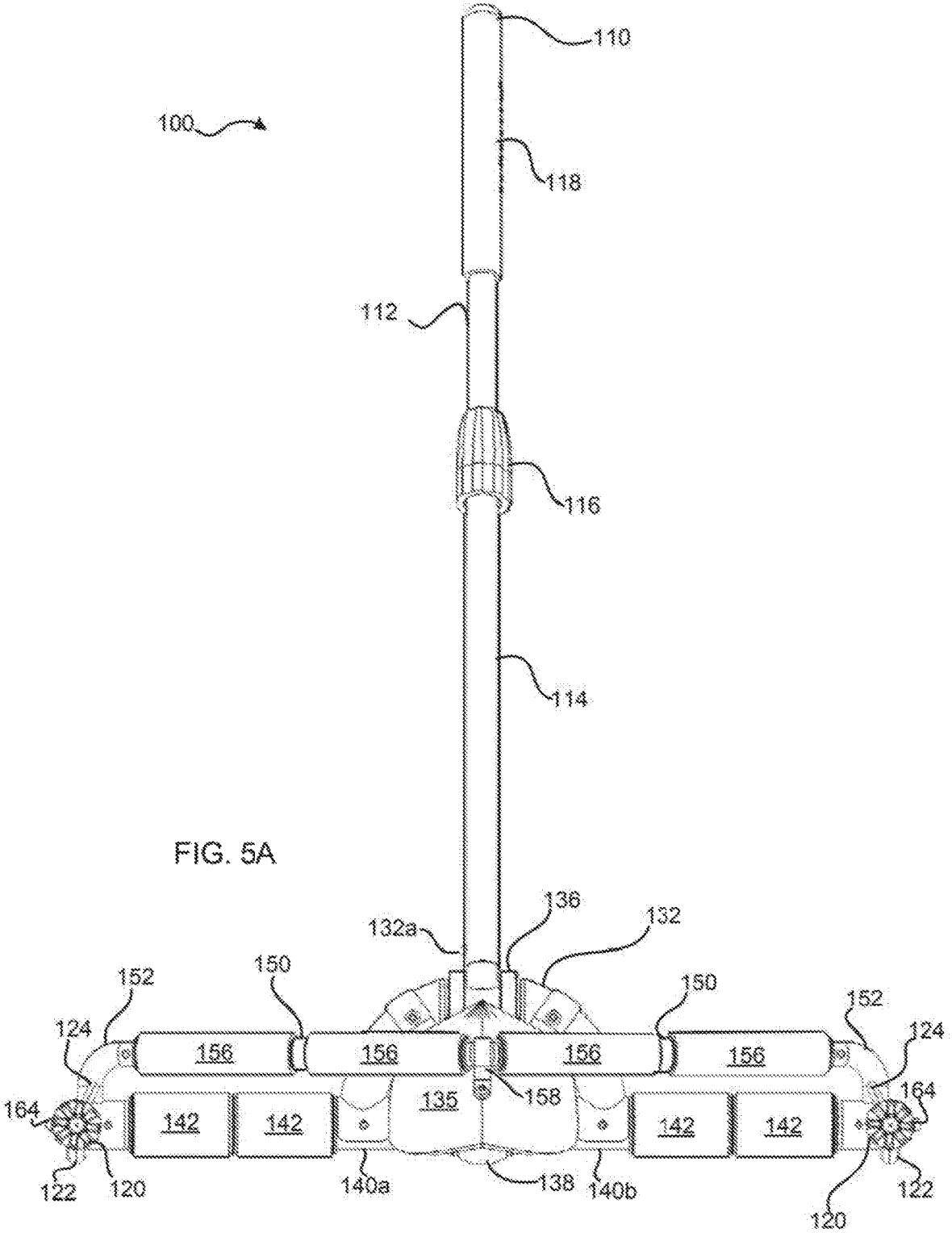
FIG. 5A is a front plan view of a ball collection device in accordance with one particular embodiment of the disclosure.
Figure 5B:
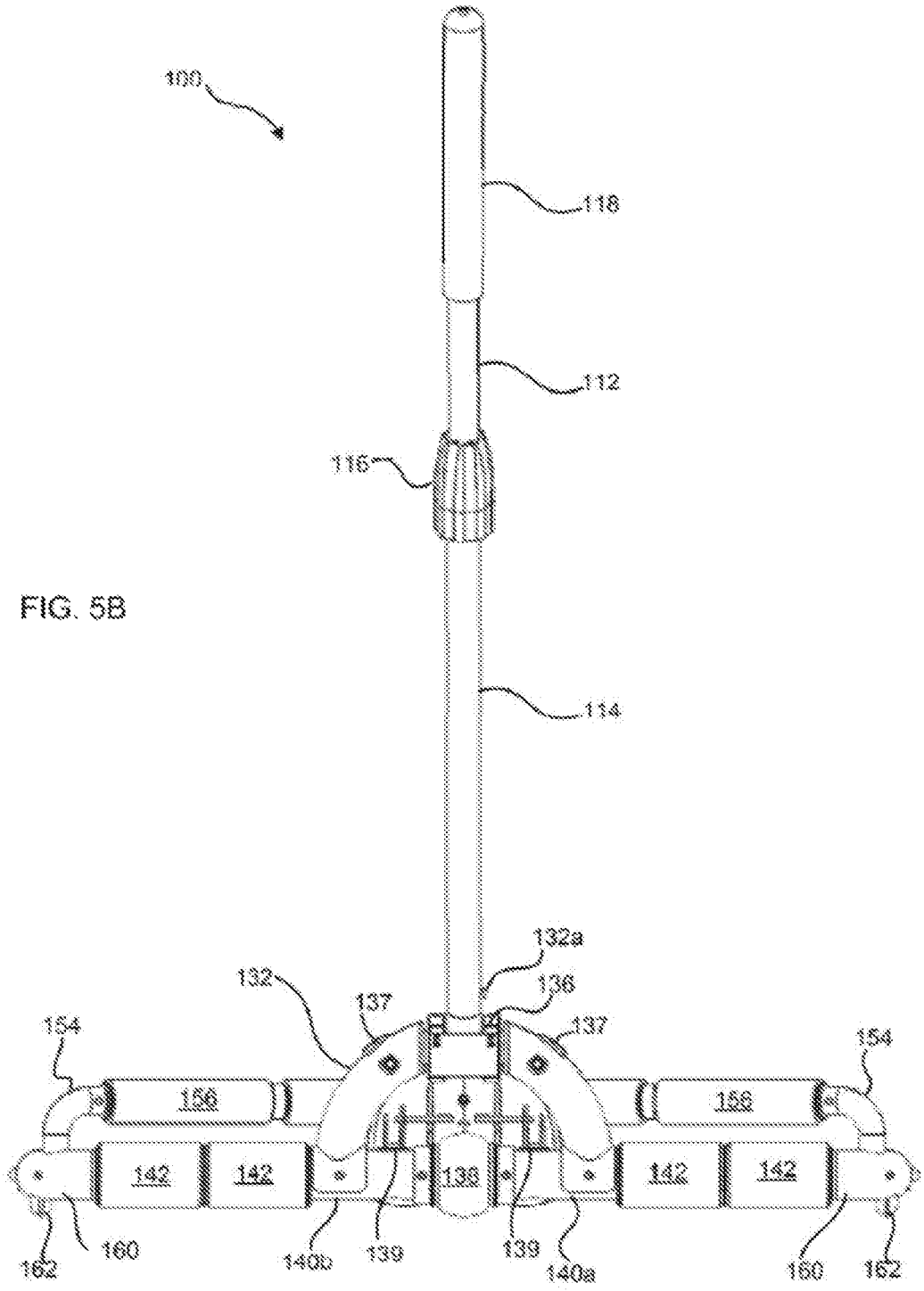
FIG. 5B is a rear plan view of a ball collection device in accordance with one particular embodiment of the disclosure.
Figure 5C:
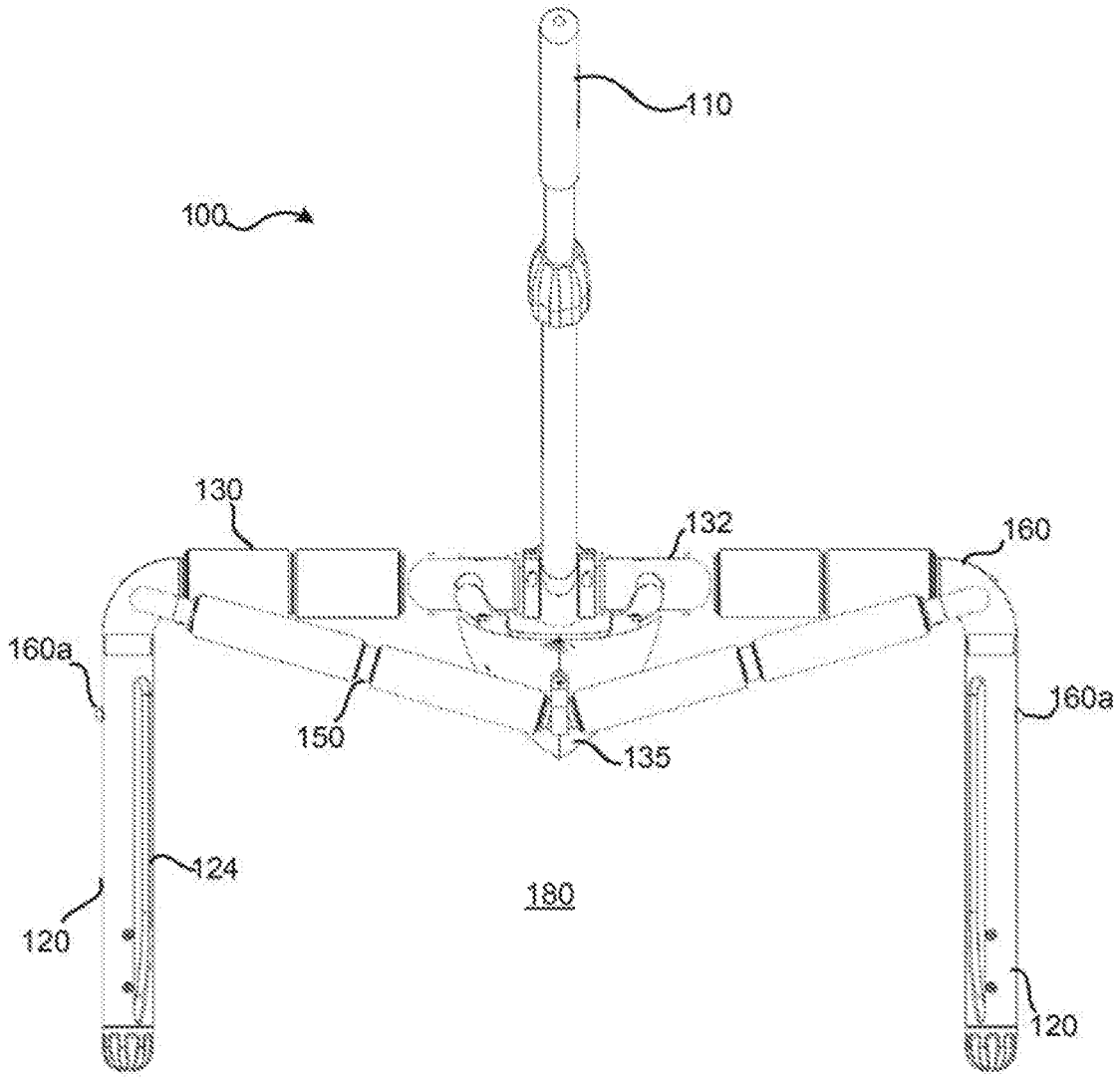
FIG. 5C is a top plan view of a ball collection device in accordance with one particular embodiment of the present disclosure.
Figure 5D:
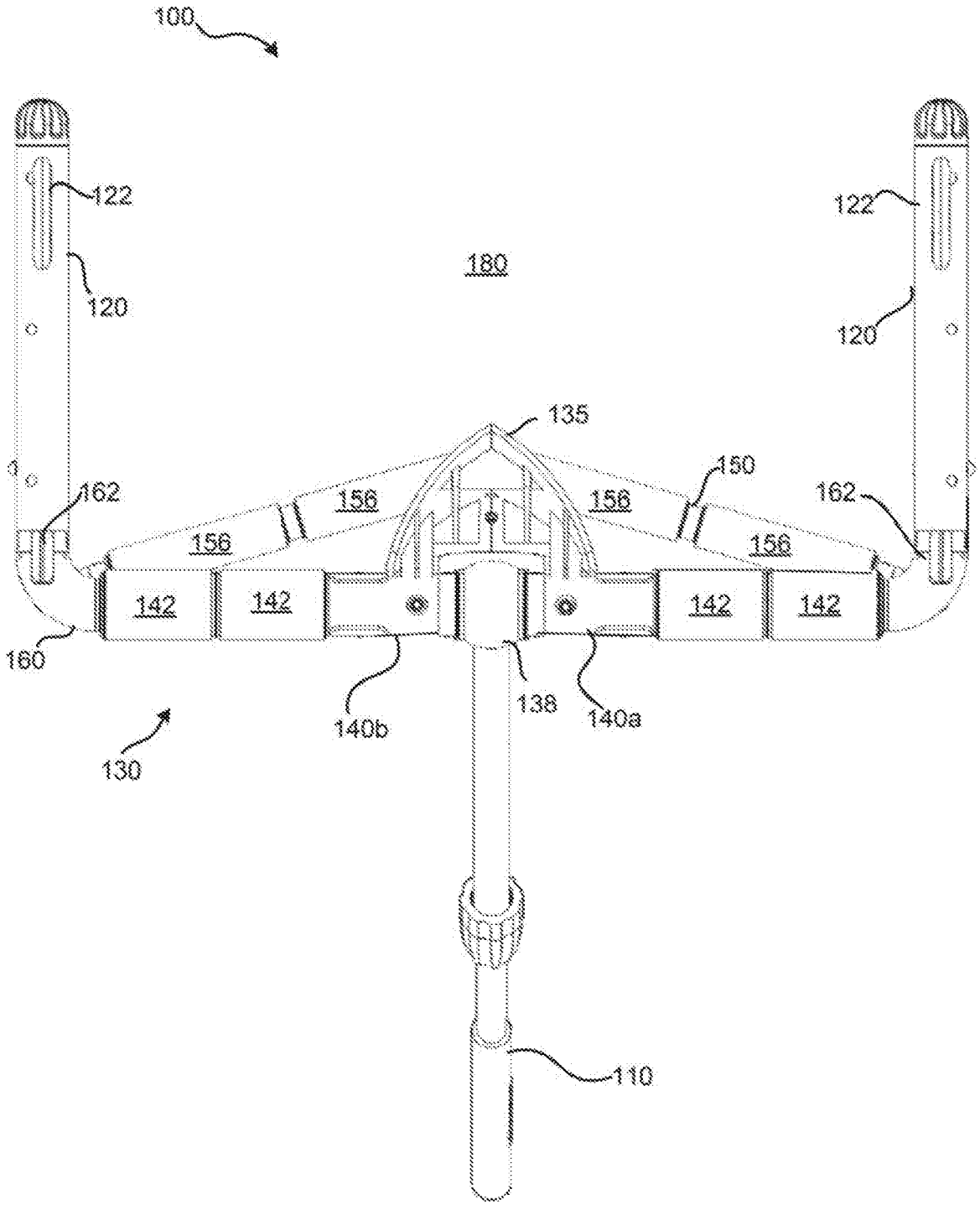
FIG. 5D is a bottom plan view of a ball collection device in accordance with one particular embodiment of the present disclosure.
Figure 5E:
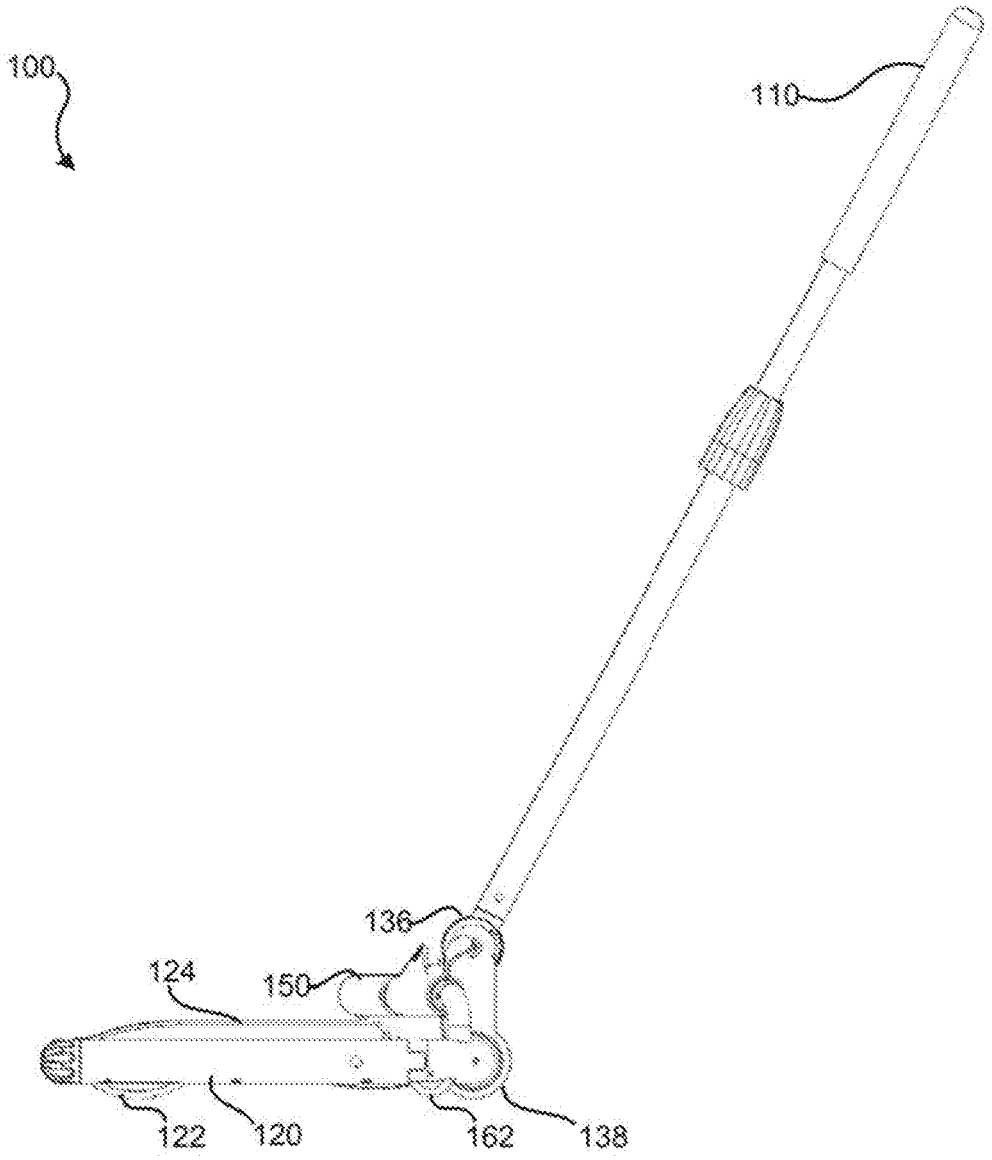
FIG. 5E is a side plan view taken from the left side of a ball collection device in accordance with one particular embodiment of the present disclosure.
Figure 5F:
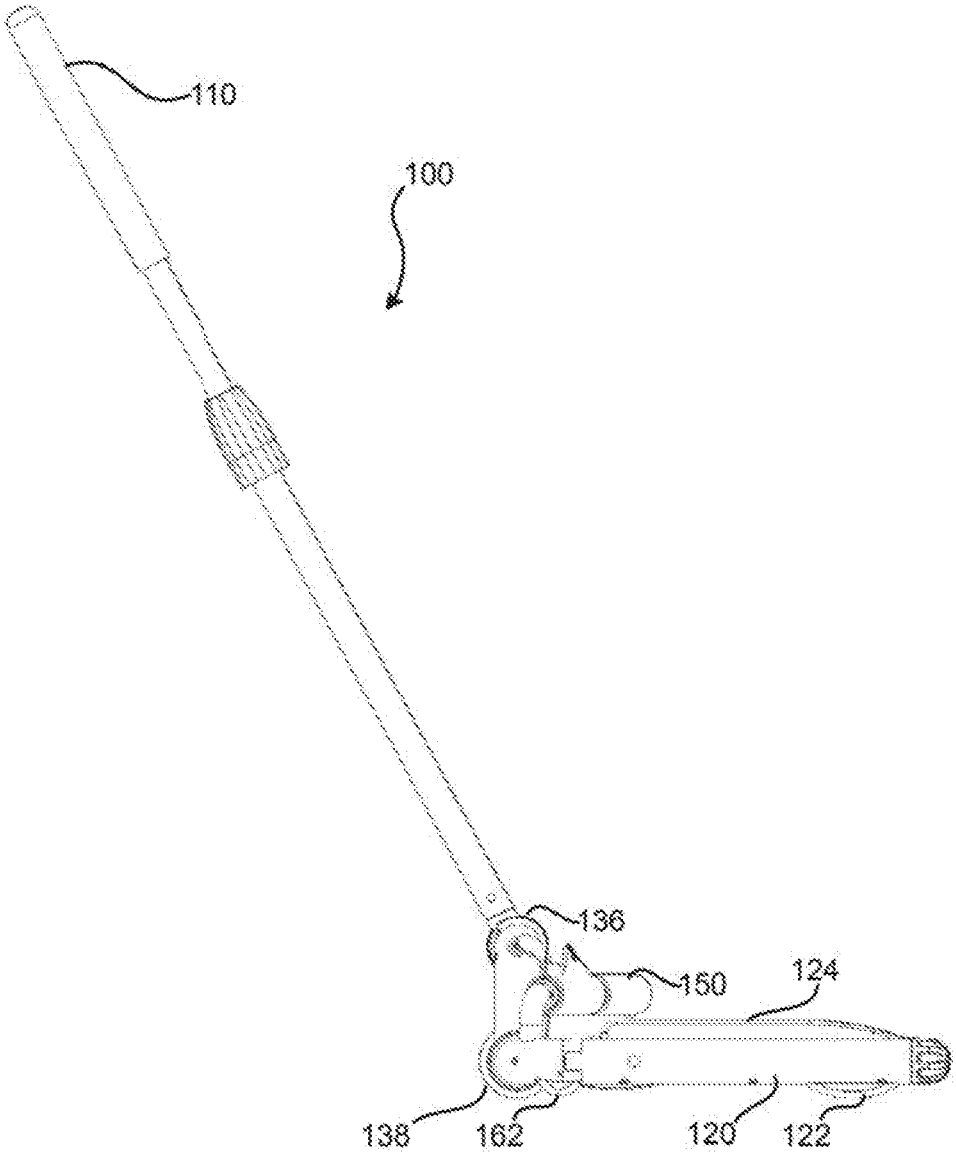
FIG. 5F is a side plan view taken from the right side of a ball collection device in accordance with one particular embodiment of the present disclosure.
Figure 6:
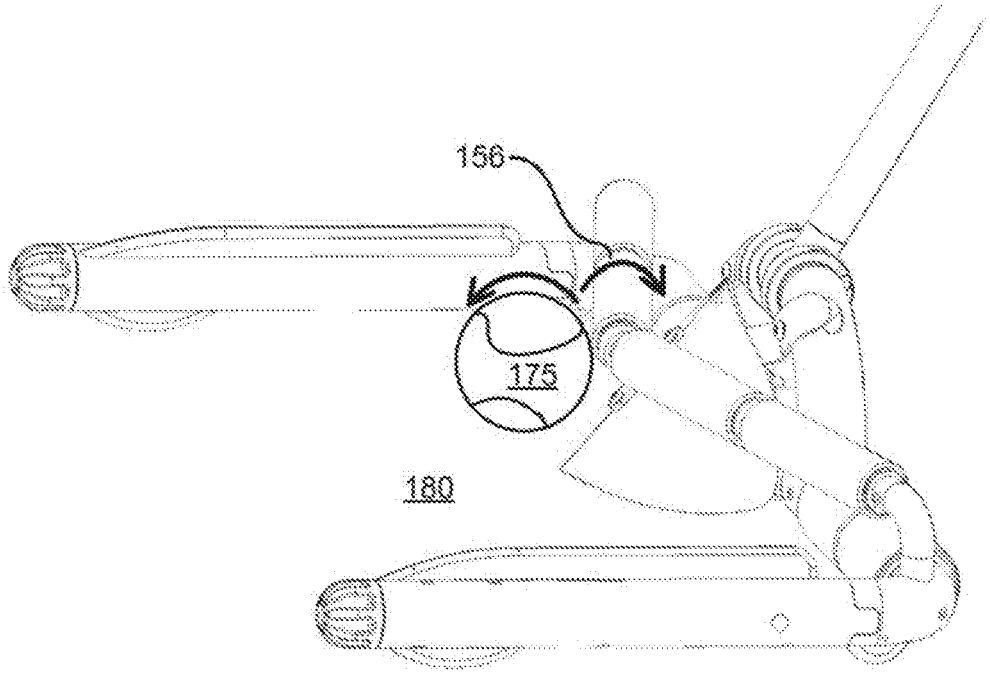
FIG. 6 is an enlarged view of a portion of the ball collector of one embodiment of the disclosure in contact with a ball located in the capture region.
Figure 7:
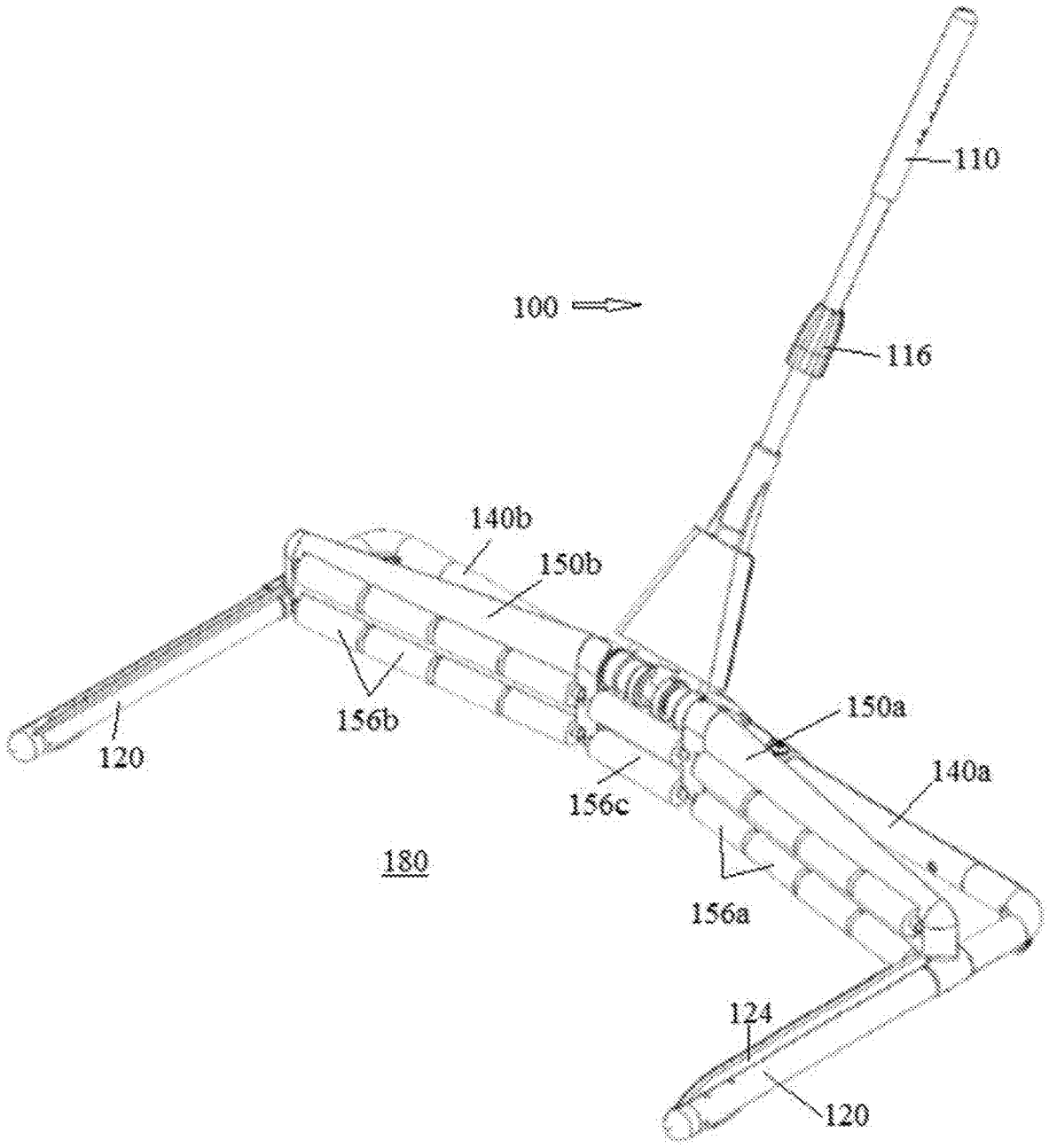
FIG. 7 is a front isometric view of another example of a ball collection device in accordance with the principles of the present disclosure.
Figure 8:
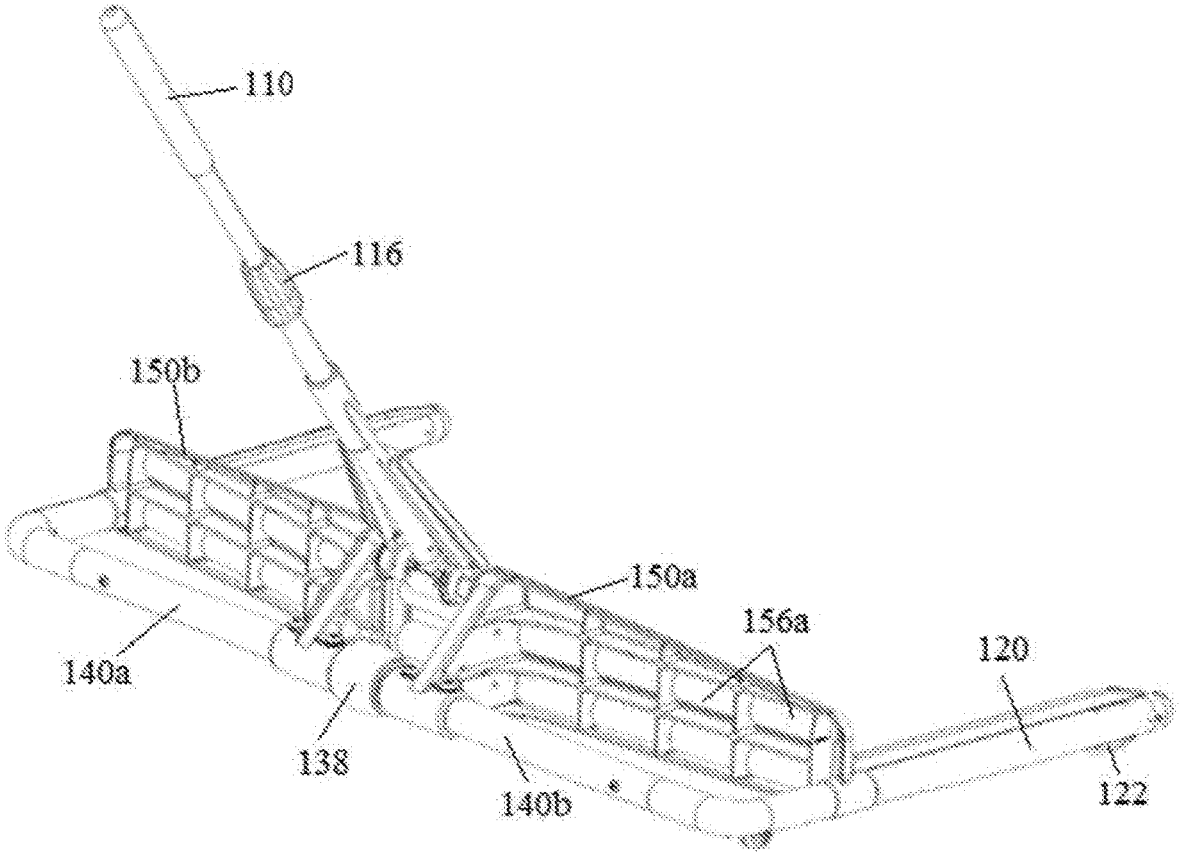
FIG. 8 is a rear isometric view of the ball collection device of FIG. 7.
Figure 9:
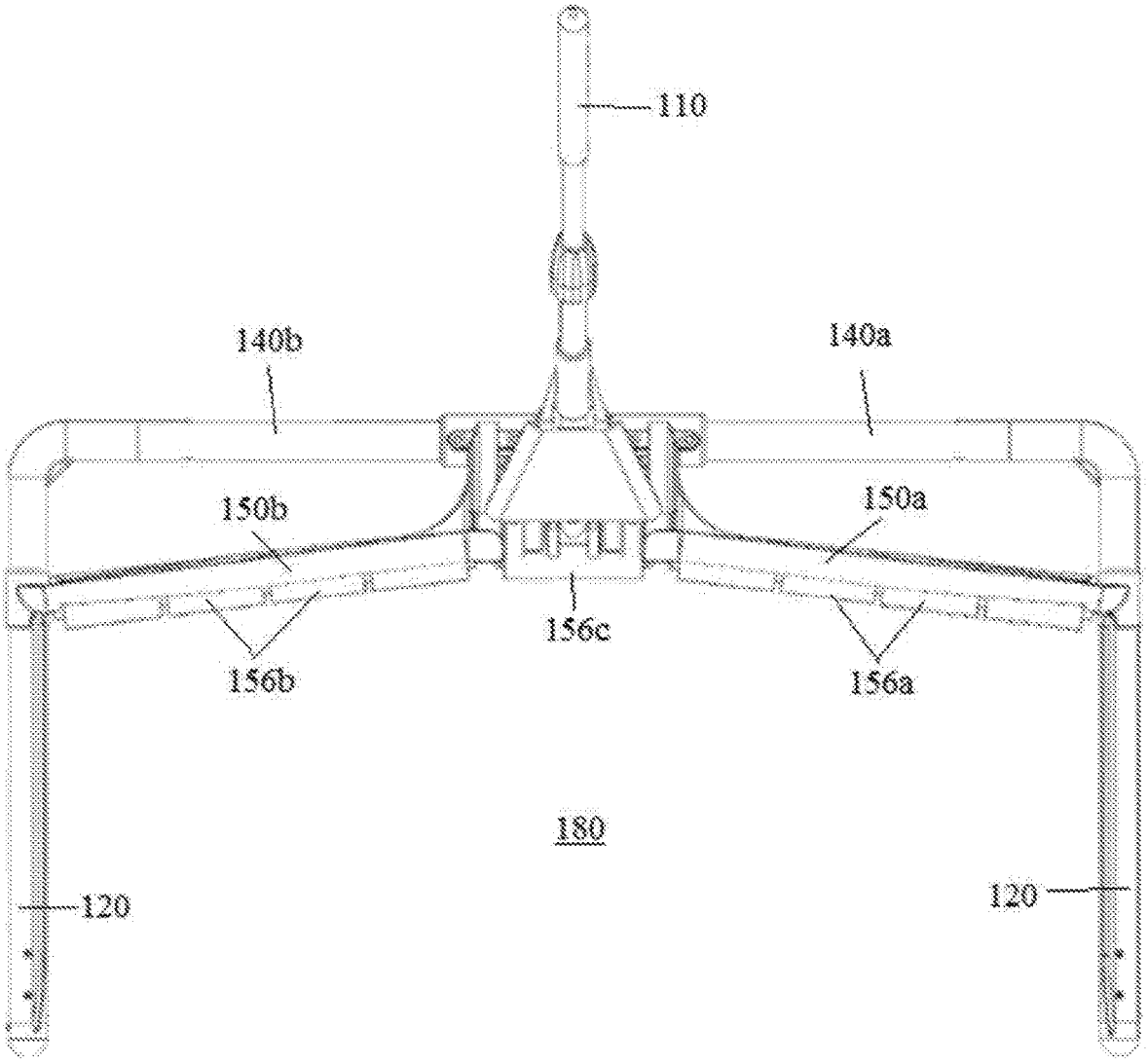
FIG. 9 is a top view of the ball collection device of FIG. 7.
Figure 10:
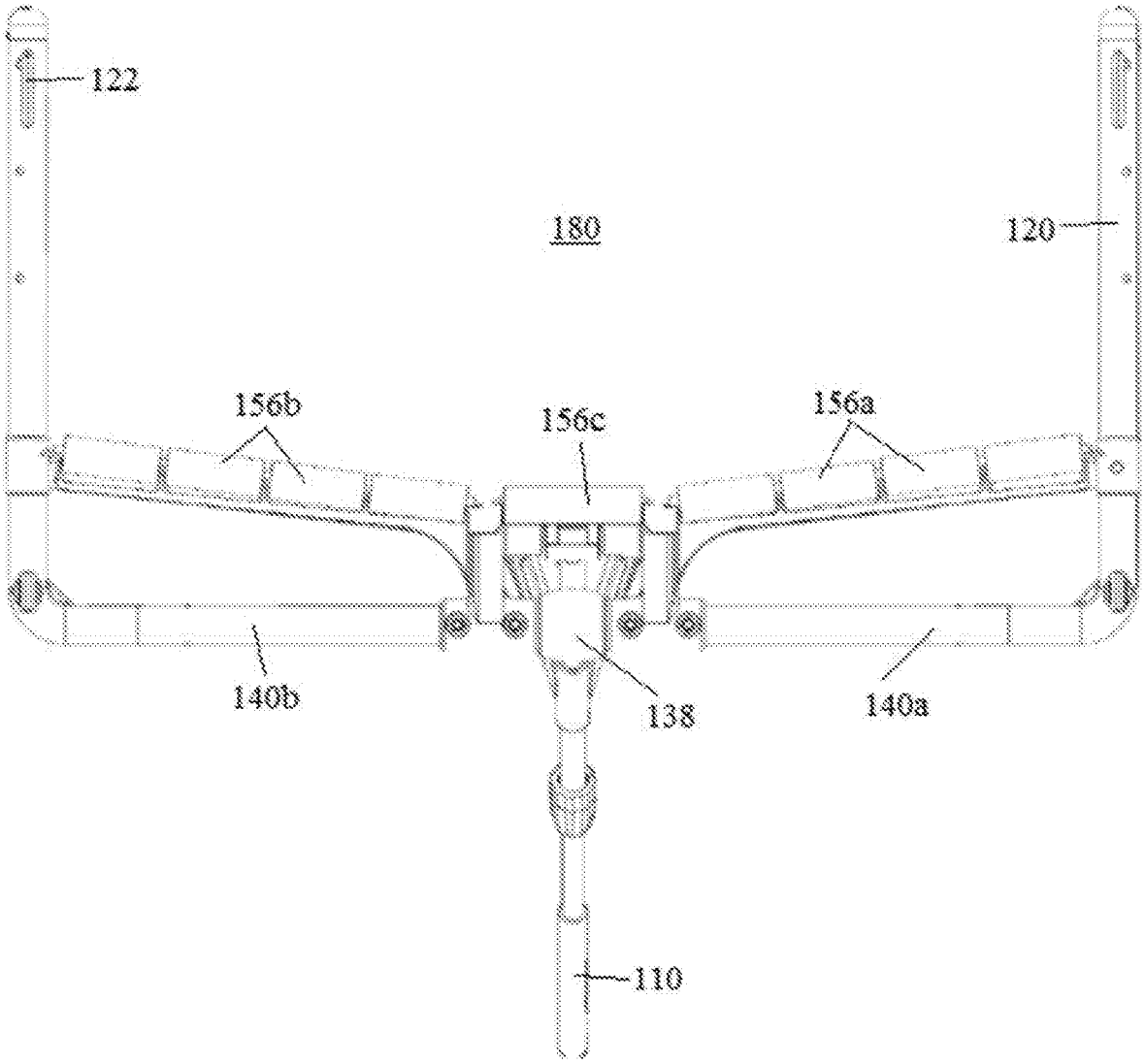
FIG. 10 is a bottom view of the ball collection device of FIG. 7.

The backplane 130 serves as the rear wall of an area or capture pen 180 in which balls 175 entering between the two arms 120 are entrapped. As such, in the present preferred embodiment, the backplane 130 is provided with several mechanisms for ensuring that the collector 100 will have great mobility while collecting balls 175 between the arms 120. Referring more particularly to FIG. 5B, the main point of ground contact for the ball collector 100 is a multi-directional center ball or roller ball 138 trapped in place between the two tube portions or segments 140*a* and 140*b* that form or constitute the bottom tube 140. In another embodiment, the roller ball 138 could be replaced by a roller mounted coaxially on a portion of the bottom tube 140. However, the use of a multi-directional center ball 138 provides a mobility that surpasses the use of a simple roller and is critical to the ability of the collector 100 to veer off quickly and easily at a tangent to the previous direction of travel of the collector 100. Consequently, the use of the roller ball 138 permits the collector 100 to easily and quickly change direction in order to collect balls 175 located at random spaced locations over a field, green or court.

For purposes of balance and ease of motion, the ball collector 100 of the present disclosure can additionally include further mobility elements aligned at its outer peripheral sides. For example, in the present embodiment shown, wheels 122 on the underside of the arms 120 and wheels 162 on the underside of the backplane 132, and more particularly, on the underside of the elbow portions 160 of the backplane 132, provide further mobility to the collector 100 and additionally serve to balance the peripheral sides of the collector 100 and arms 120 above and off of the ground, in use. It should be understood that the foregoing is not meant to limit the disclosure only to the use of wheels. Rather, for purposes of the present disclosure, the outer peripheral mobility elements can be wheels, skid pads, skis and/or rollers, as desired, without departing from the scope and spirit of the present disclosure. However, the outer peripheral mobility elements for each side of the ball collector 100 should be aligned with a longitudinal axis through the body of the arm 120 of that respective side.

The multi-directional center roller 138 entrapped between the bottom tube portions 140*a* and 140*b*, is protected in the front capture region or pen 180 (i.e., the region between the arms 120 and the backplane 130) by a ball shield 135. Ball shield 135 overlays the roller ball 138 in the front, to prevent balls 175 in the front capture region 180 from becoming entangled with the roller ball 138, or knocking the roller ball 138 out from between the bottom tube portions 140*a* and 140*b*. In the present particular embodiment illustrated, the ball shield 135 is V-shaped, with the point of the "V" aligned under a correspondingly V-shaped crossbar 150. The V-shaped example of the shield 135 directs and deflects balls and/or other external objects toward the sides or arms 120 of the capture region 180. Additionally, the ball shield 135 is held in place and stabilized by multiple points of contact with other frame portions of the backplane 130. For example, in the present preferred embodiment, the ball shield 135 includes braces 137 attached to the support bracket 132, braces 139 attached to each of the bottom tube portions 140*a* and 140*b*, and a central bracket 158 that secures the front of the ball shield 125 to the crossbar 150 and maintains its position relative thereto. Additionally, in one particular embodiment of the disclosure, the ball shield 135 includes flanges on its inner surface, to provide strength to the shield 135 and prevent deformation when impacted by a ball caught in the capture region 180.

Additionally, in the present preferred embodiment, the ball roller 138 is further protected by a V-shaped crossbar 150 that deflects captured balls 175 towards the sides of the capture region 180 (i.e., adjacent the arms 120), in use. More particularly, the V-shaped crossbar 150 is connected to the bottom tube 140 via the elbow portions 152 and 160. In one particular embodiment of the disclosure, the crossbar 150 includes a plurality of rollers 156 mounted coaxially around the tubular body of the crossbar 150. Each of the rollers 156 is mounted such that it can move rotationally about the body of the crossbar 150 when a tangential force is applied to the roller 156 by a ball trapped between the arms 120. Similarly, in one embodiment of the disclosure, the backplane 130 additionally includes rollers 142 circumferentially mounted around the bottom tube 140, which are designed to rotate about the bottom tube 140, when contacted by a ball trapped between the arms 120. The rollers 142, 156 help ensure that the balls 175 move ahead of the backplane 130 as the collector 100 is rolled, and that they do not become trapped under the crossbar 150 or bottom tube 140. For example, as the ball collector 100 is pushed forward in use, balls 175 in the capture region 180 will eventually contact the backplane 130 at the crossbar 150 and/or the bottom tube 140. The rollers 142, 156 will roll about the respective tube 140/crossbar 150 and keep the captured balls 175 rolling forward (in a direction opposite to the rotational direction of the rollers 142, 156, as shown more particularly in FIG. 6), rather than allowing them to be pushed into the turf or trapped under the crossbar 150 or tube 140. In addition, the rollers 156 and/or the crossbar 150 may be vertically configured at a position with a sufficient height to allow the rollers 156 to prevent any balls from cascading or rolling over the top of the backplane 130 when the device 100 is used to gather large numbers (or sizes) of balls.

Providing the rollers 142, 156 of the backplane 130 also ensures that much less rotational friction exists for heavy balls, such as baseballs, that buttress up to the collector surfaces at the back portion of the capture region 180. Additionally, the reduction in rotational friction due to the rollers 142, 156 preserves operator mobility (i.e., the ability to continue pushing and operating the collector 100) when a high volume of heavy-type balls (such as baseballs) are in the capture region 180. Thus, the backplane rollers 142, 156 provide an efficient way to preserve the mobility of the ball collector 100. This feature of the ball collector 100 has industrial application, as it permits the ball collector 100 to be used to collect a broader range of balls, including heavier balls like baseballs, than other ball collectors presently available. The rollers 142, 156, in combination with the roller ball 138 of the backplane, provide a ball collector 100 that is much more user friendly than other ball collector devices currently known.

The backplane 130 additionally includes elbows 160, which curve around 90 degrees, or substantially 90 degrees, from the ends of the tube portions 140*a* and 140*b* distal from the roller ball 138. One end of each elbow is connected to the bottom tube 140, while the other end provides a connection for the arms 120. Additionally, the elbows 160 include a connection for receiving elbows 152, to which the crossbar 150 is connected. The elbows 152 raise the plane of the crossbar above the plane of the bottom tube 140. The raised crossbar 150 prevents balls 175 in the capture region 180 from being bounced or spun over the back of the collector 100 (i.e., over the bottom tube 140.

It should be noted that each of the components should be sized for the ball intended to be gathered in the capture region 180 of a particular ball collector 100. A ball collector 100 configured for collecting tennis balls or baseballs will have a lower crossbar 150 (i.e., a shorter elbow 152), as compared to a collector 100 configured to collect soccer balls or basketballs. In one particular embodiment of the disclosure, the crossbar 150 is omitted when the balls 175 to be collected are too small to need or contact the crossbar 150 (e.g., golf balls or table tennis balls). Each of the elbows 160, 152 of the present embodiment are configured to be removable from the backplane 130. For example, the elbow 152 may be attached to the elbow 160 using a spring pin hole arrangement, or even a friction fit, as desired. Similarly, each elbow 160 may be attached to the bottom tube 140 using a spring pin hole arrangement, or even a friction fit, as desired. The free end of each elbow 160 (i.e., the end not received in the tube 140) is configured to removably attach to one of the arms 120.

The Arms: Each of the arms 120 is configured to connect to, and be removable from, the backplane 130. In one particular embodiment of the disclosure, each arm 120 is attached to the backplane 130 at an elbow 160, via a fastener 120*a* which, in the present embodiment, is illustrated as a spring pin 160*a* on the elbow 160 that mates with a hole 120*a* through the shaft of each arm 120. The disclosure is not meant to be limited to this, however, as the arms 120 can be welded or otherwise permanently fixed to the backplane 130 without departing from the scope of the present disclosure.

Each of the arms 120 includes a mobility element, which, in the illustrated case, is a wheel or roller 122 aligned with the wheel or roller 162 of the elbow 160 along the longitudinal axis of the arm 120. As discussed hereinabove, this is not meant to be limiting, as other types of mobility elements can be used for the outer peripheral portions of the collector 100. In one particular embodiment, one or both of the wheels 122, 162 on each side of the collector 100 is/are replaced by a skid pad. In another particular embodiment of the disclosure both wheels 122, 162 on each side of the collector 100 are replaced by one or more skis. Other types of mobility elements can be used without departing from the scope or spirit of the present disclosure.

Additionally, in the present preferred embodiment, each of the arms 120 includes a wing 124 mounted to the upper surface portion thereof. The wings 124 are pigeon toed-in or angled in towards the capture region 180, to deflect and maintain balls 175 in the capture region 180. In one particular embodiment of the disclosure, the arms 120 are streamlined and designed to aesthetically resemble an aircraft nacelle.

Now referring to FIGS. 7-10, another example of the ball collection device 100 is shown having many of the features described above (e.g., many of the same components, detachment and disassembly constructs, etc.). In the illustrated example, the backplane 130 includes the crossbar 150 and components coupled thereto, which may include crossbar segments or portions 150*a* and 150*b* coupled to the handle 110 and the arms 120. Each crossbar segment or portion may include a tube, frame, or other mechanical construct configured to provide the functionality and features described herein. The crossbar segments 150*a*, 150*b* create or define the ball capture region 180 with the arms 120. The crossbar segments 150*a*, 150*b* may be horizontally offset from the tube portions 140*a*, 140*b* to create the ball capture region forward of the tube portions 140*a*, 140*b*.

The rollers 156 may be rotatable disposed or coupled to the crossbar 150 or portions thereof. For example, each of crossbar segment 150*a* and 105*b* may include a plurality of rollers 156*a*, 156*b* mounted thereon. The pluralities of roller 156*a*, 156*b* may each include two rows of rollers 156 vertically adjacent and parallel to each other. The vertical spacing and/or positioning of the higher or upper row of rollers 156*a*, 156*b* may be configured to provide sufficient height to allow the upper row of rollers to prevent any balls from cascading or rolling over the top of the backplane 130 when the device 100 is used to gather large numbers (or sizes) of balls. Moreover, although the rollers are illustrated as substantially aligned with one another (see, e.g., the top view of FIG. 9), the rows of rollers may also be angled or horizontally offset from each other as well to provide an angled collection plane that can knock down any balls that bounce up or accumulate in front of the rollers when using the device. To that effect, the upper rows of rollers may be positioned at least partially forward of the lower rows of rollers, creating somewhat of a roller overhang on the crossbar 150.

The ball collection device 100 may also include one or more rollers 156*c* between the crossbar segment 150*a* and 105*b* and/or otherwise substantially in the middle of the crossbar 150 in proximity to the multi-directional roller ball 138. The rollers 156*c* may be included on the device 100 as an alternative to the shield 135. The rollers 156*c* shield and direct balls or other external objects away from the roller ball 138 and back toward the capture region 180.

Figure 11:
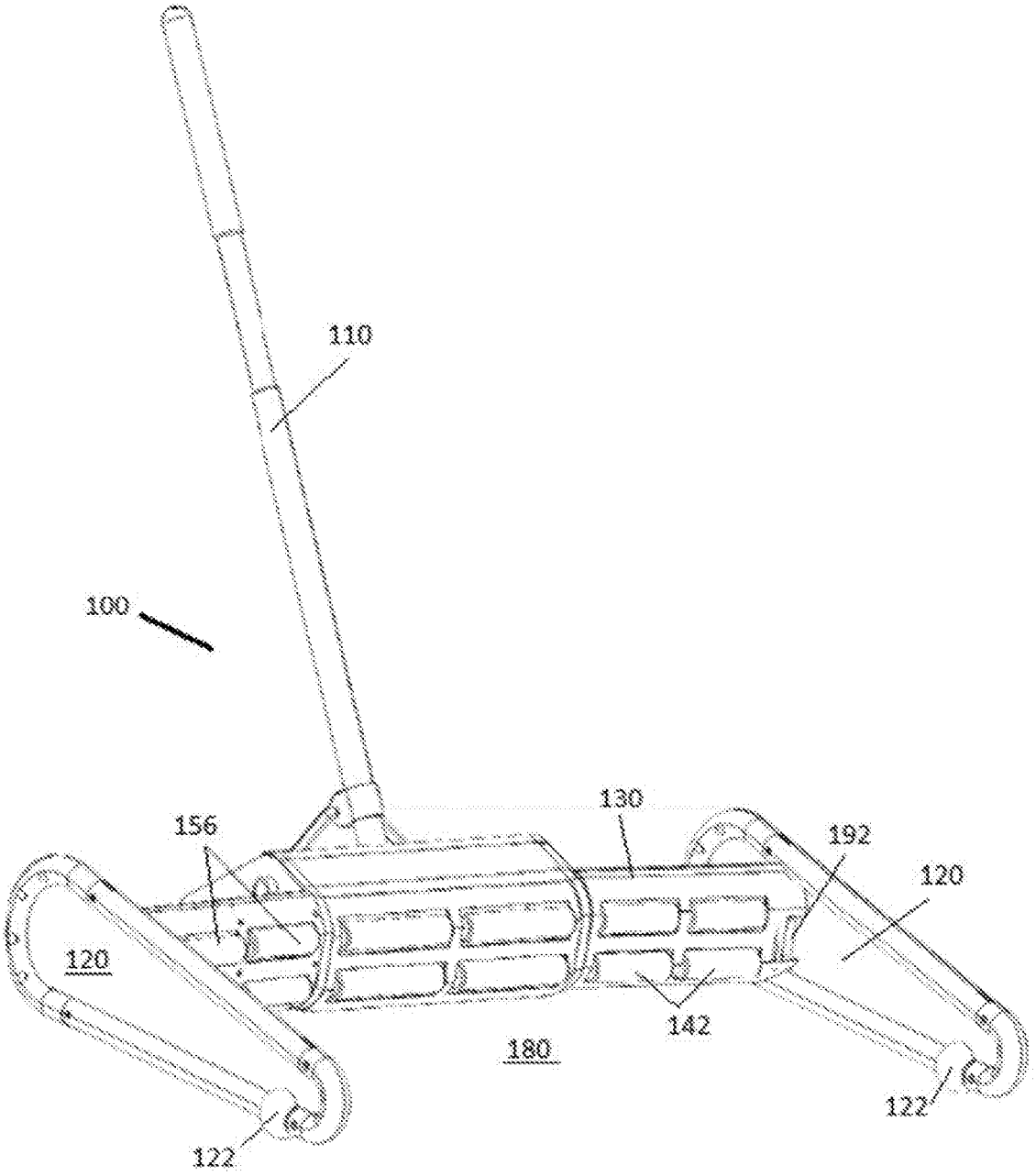
FIG. 11 is a front isometric view of another example of a ball collection device in accordance with the principles of the present disclosure.
Figure 12:
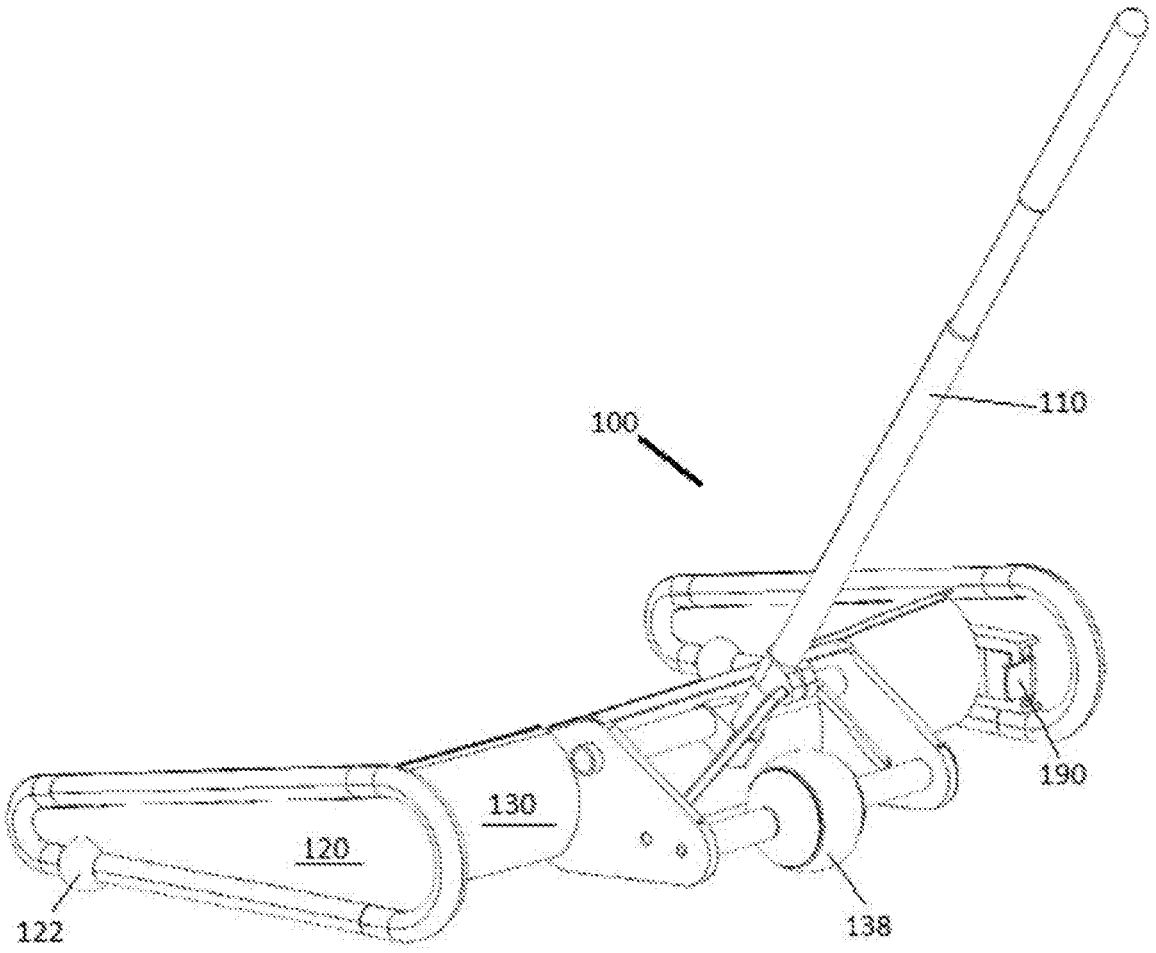
FIG. 12 is a rear isometric view of the ball collection device of FIG. 11.
Figure 13:
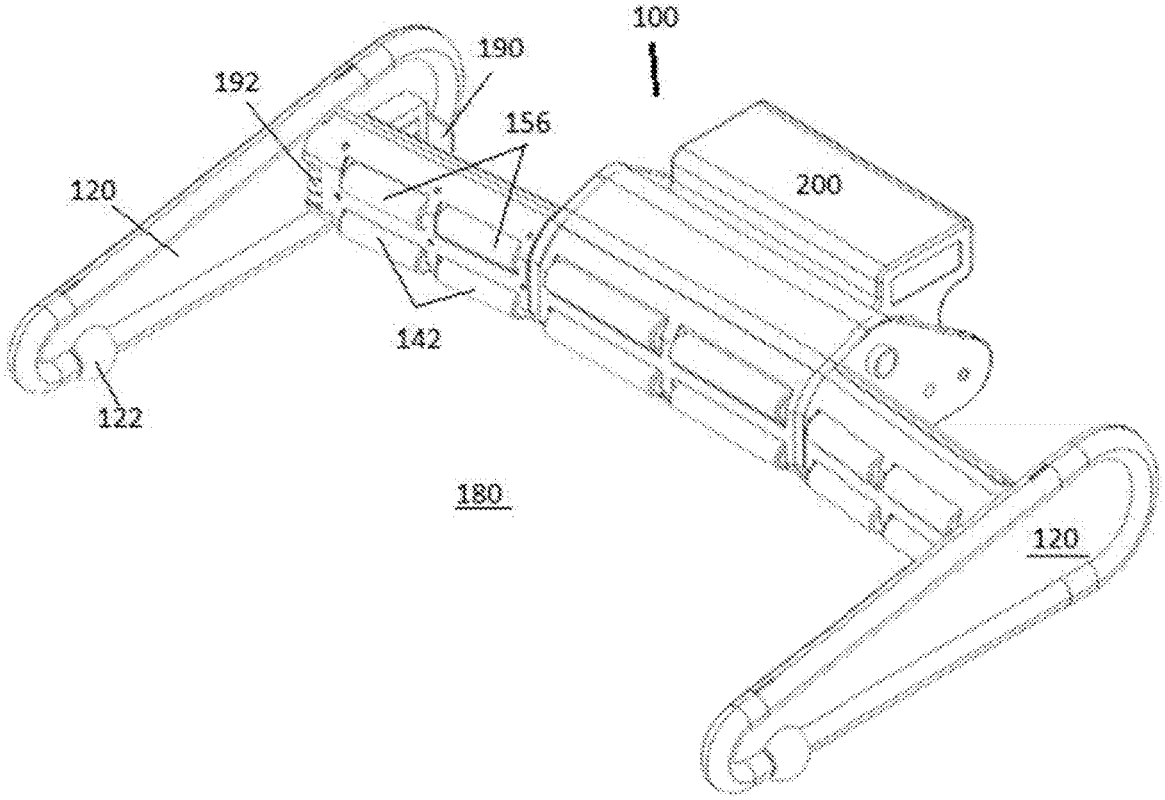
FIG. 13 is a front isometric view of another example of a ball collection device in accordance with the principles of the present disclosure.
Figure 14:
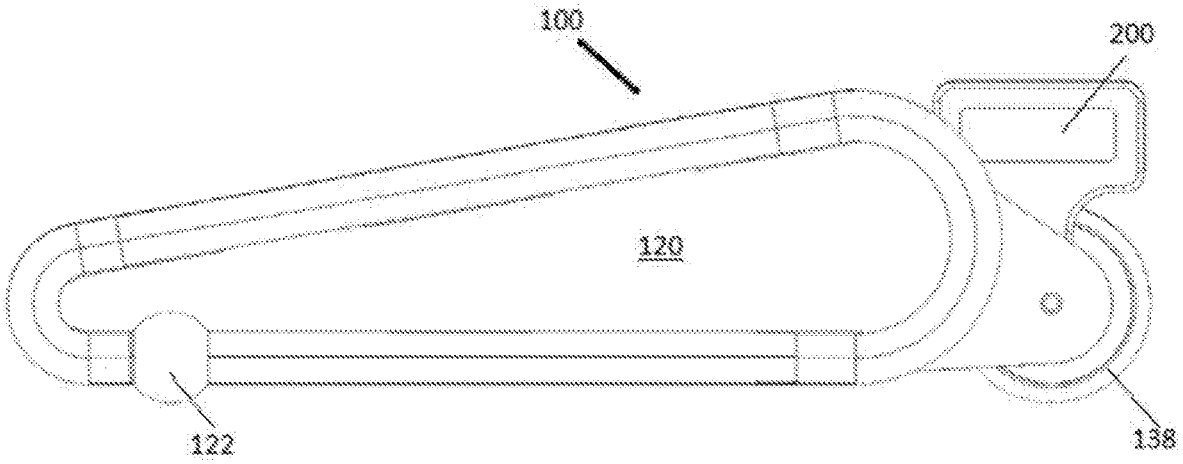
FIG. 14 is a side view of the ball collection device of FIG. 13.
Figure 15:
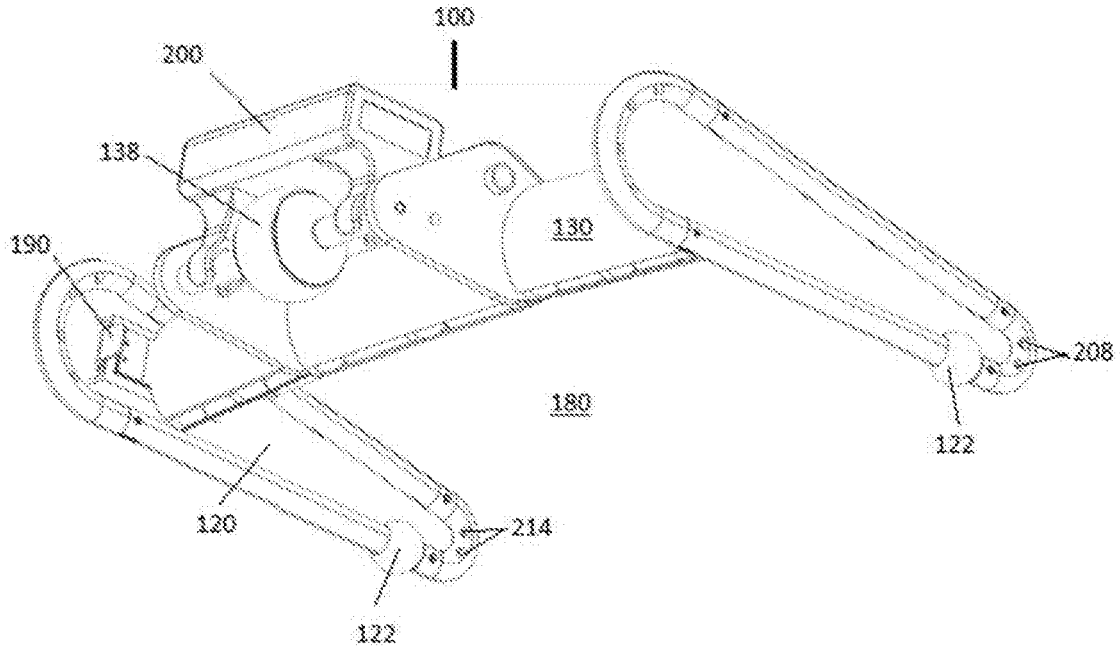
FIG. 15 is a rear isometric view of the ball collection device of FIG. 13.
Figure 16:
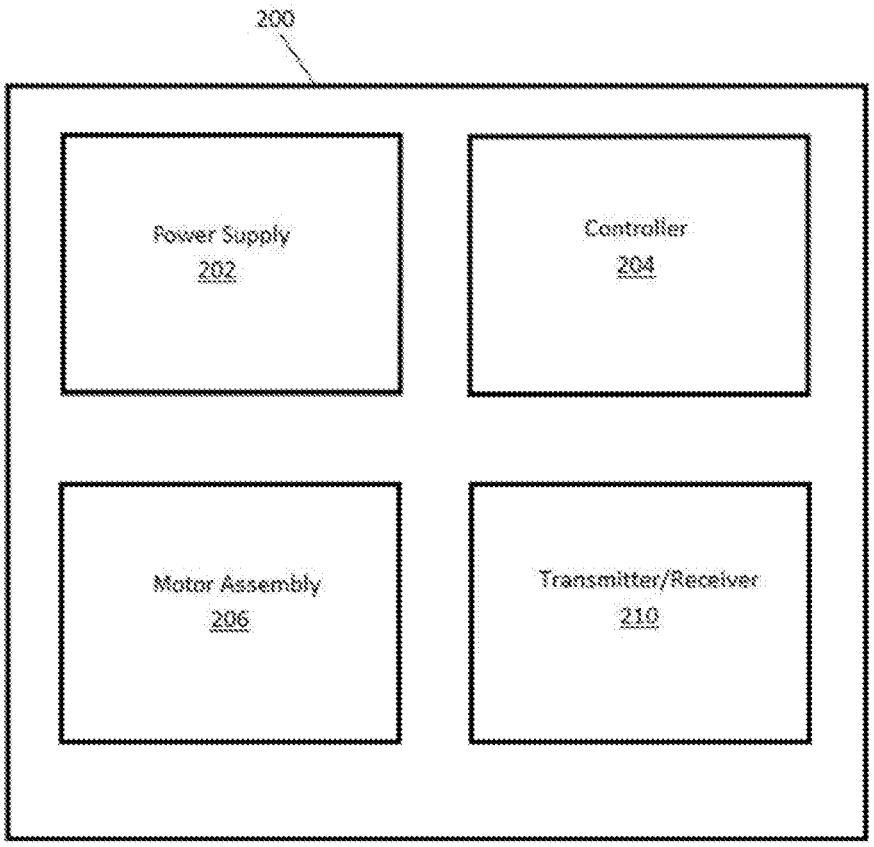
FIG. 16 is an illustrative schematic of an example of an automation assembly or module of a ball collection device in accordance with the principles of the present disclosure.

Now referring to FIGS. 11-12, another example of a ball collection device 100 is shown. This embodiment includes many of the features described herein, including the handle 110, the arms 120, backplane or base 130, multi-directional roller ball 138, and the rollers 142, 156. In the illustrated example, the arms 120 have a substantially rounded, triangular or wedge-shaped profile. The shaped profile provides a greater wall height of the arms towards the base 130 of the device 100, where larger numbers of balls will accumulate when the device 100 is being used. The arms 120 may also include a variation of the wheel 122 that reduces drag or snagging of turf, flooring, or otherwise when pushed in a forward direction, but also facilitates turning or pivoting of the device 100. For example, the wheel 122 may include a rollerball that rotates about an axis that is substantially parallel to the arms 120 to turn in a direction that is substantially perpendicular to the arms 120. In use of this particular example, the wheel 122 would not turn when the device is being pushed straight ahead, and will glide or slide across the flooring surface without rotating. However, when the device is turned (e.g., when the arms are moved laterally or rotated to the sides), then the roller ball wheels 122 will rotate as the arms 120 travel sideways. In another example, the illustrated rollerball wheels 122 may be multi-directional to provide movement and rolling in a plurality of directions along multiple axes.

Continuing to refer to FIGS. 11-12, the arms 120 may be pivotably coupled to the base 130 to allow for a reduced footprint for storage and/or traveling. For example, the device 100 may include one or more locking elements 190 and hinges 192 to allow a user to selectively secure the arms in an outward position for use (such as that shown in FIGS. 11-12), or alternatively, actuate the locking element 190 and fold the arms inward and substantially parallel to the base 130 for storage or travel.

Now referring to FIGS. 13-16, another example of a ball collection device 100 is shown that may be operated autonomously and/or automatically without manual input, control, and or steering. This example includes many of the features described herein, including the arms 120, wheels/rollerballs 122, backplane or base 130, multi-directional roller ball 138, the rollers 142, 156, and the ball capture region 180. The device 100 may also include an automation assembly 200 that facilitates hands-free operation of the device 100. The automation assembly 200 may generally include a power supply 202, a controller 204, a motor assembly 206, one or more sensors 208, and a transmitter/received 210.

The power supply 202 may provide for corded and/or cordless electrical operation through the use of one or more batteries (replaceable, semi-permanent, rechargeable, or otherwise), converters, transformers and/or other associated components to provide electrical power to the respective components of the device 100. In an alternative example, the power supply 202 may include a combustion-powered motor or generator and associated components to provide the electrical power to the components of the device 100 described herein.

The controller 204 may include one or more processors, electronic storage media, and instructions configured therewith to provide the features described herein. The motor assembly may include one or more motors, transmissions and/or gearing linkages, and operable linkages to one or more of the wheels and/or rollerballs described herein to propel the device 100 in a desired direction. The sensors 208 may include one or more proximity, position, movement, and/or contact assessment sensors positioned on or about the device (including, for example, on the base 130, the arms 120, or otherwise). The transmitter/receiver 210 may send and receive signals, information, and/or communications from external sources to allow for wireless control and/or operation of the device 100 and/or receive signals and communications from the sensors 208. Such signals and/or information may be generated and sent to the device by a remote control, a computer, a smartphone, a remotely-located base station for the device 100, or the like.

In use, the ball collector 100 is maneuvered through a court or field (either manually or under an automated operation) in order to collect balls 175 strewn therethrough. The multi-directional roller ball 138 permits the ball collector to be easily turned or maneuvered in any direction, 360 degrees relative to any point. Balls 175 are captured by capturing them between the arms 120. As the ball collector 100 is pushed forward, balls 175 in the capture region 180 between the two arms 120 contact the backplane 130 and, in particular, the bottom tube 140 and/or crossbar 150. Rollers 142, 156 on the bottom tube 140 and crossbar 150 contact the balls 175 and roll about the bottom tube 140 and crossbar 150, respectively, in order to propel the balls 175 forward with the ball collector. Balls 175 contacting the V-shaped crossbar 150, as the collector 100 is advanced, are deflected to the sides of the capture region 180 by the crossbar 150, towards the arms 120. Wings 124 on the arms 120 corral the balls 175 within the capture area.

In automated use, the controller 204 may be configured to monitor and/or receive information from the sensors 208 and adjust operation of the automation assembly 200 in response to such information or communications. For example, the controller 204 may control the operation of the motor assembly 206 to provide a desired direction and/or speed of movement of the device 100. Such speed and/or direction parameters may be initially set or input through wireless communication with the controller 204 via the transmitter/receiver 210, and/or may be contained within a preset program or set of instructions stored in one or more memory components of the controller. The sensors 208 may include proximity sensors which detect the presence of nearby objects. When nearby objects are detected by the sensors 208, the controller adjusts the operation of the motor assembly 206 to modify a speed and/or direction of the device to avoid colliding with the detected object. In addition, and/or alternatively to the sensors 208 providing proximity detection, the sensors 208 may include accelerometers and/or contact sensors that detect when the device 100 abuts against an external object, at which point the controller 204 adjusts the operation of the motor assembly 206 to modify a speed and/or direction of the device to move around and/or away from the abutted object.

The sensors 208 and/or controller 204 may be configured to detect, calculate and/or store speed, direction of travel, and/or travel duration such that the relative position of the device 100 with respect to a starting point (such as a "home" unit or station) is stored and processed within the device 100. Such information can be recalled or implemented to automatically return the device 100 its original starting point upon completion of a ball collection sweep process.

The device may include one or more sensors 214 that can detect and/or monitor a volume of collected balls within the capture region 180 and provide an alert or adjustment of the operation of the device 100 when the capture region is substantially full with collected balls. For example, the sensors 214 may be positioned on or about one or more components of the device, such as the base 130, the arms 120, or otherwise. The sensors 214 may include optical, infrared, and/or laser sensors. The sensors 214 may, for example, be positioned on a forward end of the arms 120 and detect when the captured balls substantially obstruct or fill the front area of the capture region 180 between the two arms 120, thus indicating that the capture region is substantially full. The sensors 214 may, alternatively, detect when the volume of captured balls has met or exceeded a certain height in proximity to the wall height of the base 130 and/or arms 120, and provide an indication to the controller or otherwise to abort further collection efforts and return to a home position or station.

The present disclosure provides a ball collection device as described herein. Alternate to the embodiment shown in the drawings, if desired, the collector 110 can be constructed using fewer pieces without departing from the scope or spirit of the present disclosure. For example, in one particular embodiment of the disclosure, each arm 120 can be formed with a portion of the bottom tube 140, wherein a bend is made in the tube in place of the elbow 160. Thus, in this embodiment, two unitary tube/arm portions are provided, one on either side of the ball roller 138.

As described herein, the ball collection device 100 can also be readily disassembled into the core components—the handle, the arms, and the backplane—to allow the device 100 to be stored and transported with a significantly reduced footprint, such as in a duffle bag or the like.

Aspects of the present disclosure are described with reference to flowchart illustrations and/or block diagrams of methods, apparatus (systems) and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general-purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks. Aspects of the disclosure may be implemented in any type of computing devices, such as, e.g., a desktop computer, personal computer, a laptop/mobile computer, a personal data assistant (PDA), a mobile phone, a tablet computer, cloud computing device, and the like, with wired/wireless communications capabilities via the communication channels.

Further in accordance with various aspects of the disclosure, the methods described herein are intended for operation with dedicated hardware implementations including, but not limited to, PCs, PDAs, semiconductors, application specific integrated circuits (ASIC), programmable logic arrays, cloud computing devices, and other hardware devices constructed to implement the methods described herein.

It should also be noted that the software implementations of the disclosure as described herein are optionally stored on a tangible storage medium, such as: a magnetic medium such as a disk or tape; a magneto-optical or optical medium such as a disk; or a solid-state medium such as a memory card or other package that houses one or more read-only (non-volatile) memories, random access memories, or other re-writable (volatile) memories. A digital file attachment to email or other self-contained information archive or set of archives is considered a distribution medium equivalent to a tangible storage medium. Accordingly, the disclosure is considered to include a tangible storage medium or distribution medium, as listed herein and including art-recognized equivalents and successor media, in which the software implementations herein are stored.

Additionally, the various aspects of the disclosure may be implemented in a non-generic computer implementation. Moreover, the various aspects of the disclosure set forth herein improve the functioning of the system as is apparent from the disclosure hereof. Furthermore, the various aspects of the disclosure involve computer hardware that it specifically programmed to solve the complex problem addressed by the disclosure. Accordingly, the various aspects of the disclosure improve the functioning of the system overall in its specific implementation to perform the process set forth by the disclosure and as defined by the claims.

Aspects of the disclosure may include communication channels that may be any type of wired or wireless electronic communications network, such as, e.g., a wired/wireless local area network (LAN), a wired/wireless personal area network (PAN), a wired/wireless home area network (HAN), a wired/wireless wide area network (WAN), a campus network, a metropolitan network, an enterprise private network, a virtual private network (VPN), an internetwork, a backbone network (BBN), a global area network (GAN), the Internet, an intranet, an extranet, an overlay network, Near field communication (NFC), a cellular telephone network, a Personal Communications Service (PCS), using known protocols such as the Global System for Mobile Communications (GSM), CDMA (Code-Division Multiple Access), GSM/EDGE and UMTS/HSPA network technologies, Long Term Evolution (LTE), 5G (5th generation mobile networks or 5th generation wireless systems), WiMAX, HSPA+, W-CDMA (Wideband Code-Division Multiple Access), CDMA2000 (also known as C2K or IMT Multi-Carrier (IMT-MC)), Wireless Fidelity (Wi-Fi), Bluetooth, and/or the like, and/or a combination of two or more thereof. The NFC standards cover communications protocols and data exchange formats, and are based on existing radio-frequency identification (RFID) standards including ISO/IEC 14443 and FeliCa. The standards include ISO/IEC 18092[3] and those defined by the NFC Forum.

It will be appreciated by persons skilled in the art that the present disclosure is not limited to what has been particularly shown and described herein above. In addition, unless mention was made above to the contrary, it should be noted that all of the accompanying drawings are not to scale. Of note, the system components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein. Moreover, while certain embodiments or figures described herein may illustrate features not expressly indicated on other figures or embodiments, it is understood that the features and components of the examples disclosed herein are not necessarily exclusive of each other and may be included in a variety of different combinations or configurations without departing from the scope and spirit of the disclosure. A variety of modifications and variations are possible in light of the above teachings without departing from the scope and spirit of the disclosure, which is limited only by the following claims.

What is claimed is:

1. A ball collection device, comprising:

a base;

a plurality of rollers coupled to the base;

a first arm coupled to and extending substantially perpendicular from the base, wherein the first arm is selectively removable from the base;

a second arm coupled to and extending substantially perpendicular from the base, wherein the second arm is selectively removable from the base;

a rollerball coupled to at least one of the first and second arms; and at least one of a ball and a wheel movably coupled to the base.

2. The ball collection device of claim 1, wherein the at least one of a ball and a wheel is a multi-directional roller ball.

3. The ball collection device of claim 1, further comprising an elongated handle extending from the base, wherein the elongate handle is selectively removable from the base.

4. The ball collection device of claim 3, wherein a length of the handle is selectively adjustable.

5. The ball collection device of claim 1, wherein the plurality of rollers includes at least two rows of rollers, and wherein the at least two rows are substantially parallel to each other.

6. The ball collection device of claim 1, wherein each of the plurality of rollers is rotatable around an axis that is substantially parallel to the base.

7. The ball collection device of claim 1, wherein the base and the first and second arms form a ball capture region, and wherein the first and second arms each include a wing extending at an angle therefrom configured to direct balls towards the ball capture region.

8. The ball collection device of claim 1, wherein the first and second arms define a capture region therebetween, and the device further comprises at least one sensor configured to detect objects located in the capture region.

9. The ball collection device of claim 8, wherein the at least one sensor is at least one of an optical sensor, an infrared sensor, and a laser sensor.

10. A ball collection device, comprising:

a base;

a plurality of rollers coupled to the base;

a first arm coupled to and extending substantially perpendicular from the base, wherein the first arm is selectively removable from the base;

a second arm coupled to and extending substantially perpendicular from the base, wherein the second arm is selectively removable from the base;

at least one of a ball and a wheel movably coupled to the base; and a motor coupled to the base configured to propel the ball collection device.

11. The ball collection device of claim 10, further comprising:

a controller coupled to the base; and at least one sensor in communication with the controller and configured to detect contact between the device and another object, wherein the controller is configured to modify operation of the motor at least based in part on a communication received from the at least one sensor.

12. The ball collection device of claim 10, further comprising:

a controller coupled to the base; and at least one proximity sensor in communication with the controller, wherein the controller is configured to modify operation of the motor at least based in part on a communication received from the at least one proximity sensor.

13. A ball collection device, comprising:

a base;

a plurality of rollers coupled to the base;

a first arm coupled to and extending substantially perpendicular from the base, wherein the first arm is pivotable with respect to the base to be positioned substantially parallel to the base;

a second arm coupled to and extending substantially perpendicular from the base, wherein the second arm is pivotable with respect to the base to be positioned substantially parallel to the base;

at least one of a ball and a wheel movably coupled to the base;

a motor coupled to the base configured to propel the ball collection device;

a controller coupled to the base; and at least one sensor in communication with the controller and configured to detect contact between the device and another object, wherein the controller is configured to modify operation of the motor at least based in part on a communication received from the at least one sensor.

14. The ball collection device of claim 13, wherein at least one of the first and second arms defines a rounded triangular shape.

15. The ball collection device of claim 13, further comprising an elongated handle extending from the base, wherein the elongate handle is selectively removable from the base, and wherein a length of the handle is selectively adjustable.

16. The ball collection device of claim 13, wherein the plurality of rollers includes at least two rows of rollers, and wherein the at least two rows are substantially parallel to each other.

17. The ball collection device of claim 13, wherein the base and the first and second arms form a ball capture region, and wherein the first and second arms each include a wing extending at an angle therefrom configured to direct balls towards the ball capture region.

18. The ball collection device of claim 13, wherein the first and second arms define a capture region therebetween, and the device further comprises at least one of an optical sensor, an infrared sensor, and a laser sensor configured to detect objects located in the capture region.

* * * * *